US010196221B2

(12) United States Patent
Okamoto

(10) Patent No.: US 10,196,221 B2
(45) Date of Patent: Feb. 5, 2019

(54) SHEET CONVEYER AND IMAGE FORMING APPARATUS

(71) Applicant: Brother Kogyo Kabushiki Kaisha, Nagoya-shi, Aichi-ken (JP)

(72) Inventor: Yoshihiro Okamoto, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/672,376

(22) Filed: Aug. 9, 2017

(65) Prior Publication Data

US 2018/0057289 A1 Mar. 1, 2018

(30) Foreign Application Priority Data

Sep. 1, 2016 (JP) ..... 2016-171116

(51) Int. Cl.
*B65H 3/06* (2006.01)
*B41J 15/04* (2006.01)
*B65H 1/04* (2006.01)

(52) U.S. Cl.
CPC ..... *B65H 3/0684* (2013.01); *B41J 15/042* (2013.01); *B41J 15/044* (2013.01); *B65H 1/04* (2013.01); *B65H 3/0669* (2013.01); *B65H 2403/481* (2013.01); *B65H 2403/51* (2013.01); *B65H 2405/11* (2013.01)

(58) Field of Classification Search
CPC ... B65H 3/0684; B65H 3/0607; B65H 3/0669
USPC ..... 271/114, 117, 118
See application file for complete search history.

(56) References Cited

U.S. PATENT DOCUMENTS 5,497,986 A * 3/1996 Kudo ..... B65H 3/5261 271/110
9,272,860 B2 * 3/2016 Maehara ..... B65H 3/0684
2012/0237279 A1 9/2012 Ichikawa
2013/0193632 A1 * 8/2013 Hida ..... B65H 3/0684 271/10.11
2015/0014914 A1 * 1/2015 Sung ..... H04N 1/00652 271/110

FOREIGN PATENT DOCUMENTS

JP H07-97078 A 4/1995
JP 2012-188283 A 10/2012

* cited by examiner

*Primary Examiner* — Thomas A Morrison
(74) *Attorney, Agent, or Firm* — Banner & Witcoff, Ltd.

(57) ABSTRACT

A sheet conveyer, including a tray, a pickup roller, a separator roller, a separator pad, a driving source, a roller holder with an arm, an engagement member engageable with the arm, a load applier lever, and a first urging member coupled with the load applier lever, is provided. The load applier lever is movable between a first position, wherein the load applier lever supports the first end of the first urging member at a position where the first urging member causes the engagement member to be urged against the arm and to apply a load that acts in a direction to cause the pickup roller to be pressed against the sheets to the arm; and a second position, wherein the load applier lever supports the first end of the first urging member at a position where the first urging member is in the natural length thereof.

9 Claims, 15 Drawing Sheets

SHEET CONVEYER AND IMAGE FORMING APPARATUS

CROSS REFERENCE TO RELATED APPLICATION

This application claims priority from Japanese Patent Application No. 2016-171116, filed on Sep. 1, 2016, the entire subject matter of which is incorporated herein by reference.

BACKGROUND

Technical Field

An aspect of the present disclosure is related to a sheet conveyer having a pickup roller and a separator roller and to an image forming apparatus having the sheet conveyer.

Related Art

A sheet conveyer, having a pickup roller to feed sheets supported on a tray and a separator roller to separate the fed sheets from one another is known. The pickup roller may be urged against the sheets by a predetermined intensity of pressure merely when the sheets are fed and separated, and the pickup roller may be uplifted to be separated from the sheets on the tray when the sheets are not to be fed.

The sheet conveyer may have a roller holder, which may be swingable about a driving shaft of the separator roller, and the pickup roller may be rotatably held by the roller holder. The pickup roller held by the roller holder may move between a first position, in which the pickup roller may contact the sheets on the tray, and a second position, in which the pickup roller may be separated from the sheets on the tray, as the roller holder swings about the driving shaft of the separator roller.

SUMMARY

With the movable structure of the pickup roller to be separated from the sheet, when no sheet is being fed, and to be moved to contact the sheet when a sheet is being fed, noticeably loud noise may be produced as the pickup roller is moved to contact or to be separated from the sheet.

The present disclosure is advantageous in that a sheet conveyer, having a pickup roller and a separator roller, in which noise to be produced when the pickup roller is moved to contact or to be separated from a sheet may be reduced, is provided. Further, an image forming apparatus having the sheet conveyer may be provided.

According to an aspect of the present disclosure, a sheet conveyer, having a tray configured to support sheets; a pickup roller configured to rotate and convey the sheets in a conveying direction; a separator roller arranged downstream from the pickup roller along the conveying direction; a separator pad arranged to face the separator roller, the separator pad and the separator roller being configured to separate the sheets conveyed by the pickup roller from one another at a position between the separator pad and the separator roller; a first rotation shaft configured to support the separator roller; a driving source configured to supply a driving force to the separator roller and the pickup roller; a roller holder having an arm, the roller holder being pivotably supported by the first rotation shaft to pivot about the first rotation shaft, the roller holder being configured to support the pickup roller rotatably to rotate about a rotation axis of the pickup roller, the roller holder being configured to support the separator roller rotatably at an intervening position between the arm and the pickup roller to rotate about the first rotation shaft; an engagement member engageable with the arm; a load applier lever; and a first urging member coupled with the load applier lever at a first end thereof and coupled with the engagement member at a second end thereof, is provided. The load applier lever is movable between a first position, in which the load applier lever supports the first end of the first urging member at a position where the first urging member is deformed from a natural length thereof and causes the engagement member coupled to the second end thereof to be urged against the arm and to apply a load that acts in a direction to cause the pickup roller to be pressed against the sheets supported on the tray to the arm; and a second position, in which the load applier lever supports the first end of the first urging member at a position where the first urging member is in the natural length thereof without causing the engagement member coupled to the second end thereof to be urged against the arm.

According to another aspect of the present disclosure, an image forming apparatus, having a sheet conveyer and an image forming unit configured to form images on the sheets conveyed by the sheet conveyer is provided. The sheet conveyer includes a tray configured to support sheets; a pickup roller configured to rotate and convey the sheets in a conveying direction; a separator roller arranged downstream from the pickup roller along the conveying direction; a separator pad arranged to face the separator roller, the separator pad and the separator roller being configured to separate the sheets conveyed by the pickup roller from one another at a position between the separator pad and the separator roller; a rotation shaft configured to support the separator roller; a driving source configured to supply a driving force to the separator roller and the pickup roller; a roller holder having an arm, the roller holder being pivotably supported by the rotation shaft to pivot about the rotation shaft, the roller holder being configured to support the pickup roller rotatably to rotate about a rotation axis of the pickup roller, the roller holder being configured to support the separator roller rotatably at an intervening position between the arm and the pickup roller to rotate about the rotation shaft; an engagement member engageable with the arm; a load applier lever; and an urging member coupled with the load applier lever at a first end thereof and coupled with the engagement member at a second end thereof. The load applier lever is movable between a first position, in which the load applier lever supports the first end of the urging member at a position where the urging member is deformed from a natural length thereof and causes the engagement member coupled to the second end thereof to be urged against the arm and to apply a load that acts in a direction to cause the pickup roller to be pressed against the sheets supported on the tray to the arm; and a second position, in which the load applier lever supports the first end of the urging member at a position where the urging member is in the natural length thereof without causing the engagement member coupled to the second end thereof to be urged against the arm.

BRIEF DESCRIPTION OF THE ACCOMPANYING DRAWINGS

DETAILED DESCRIPTION

Hereinafter, an embodiment of the present disclosure will be described with reference to the accompanying drawings.

[Overall Configuration of Image Forming Apparatus]

Figure 1:
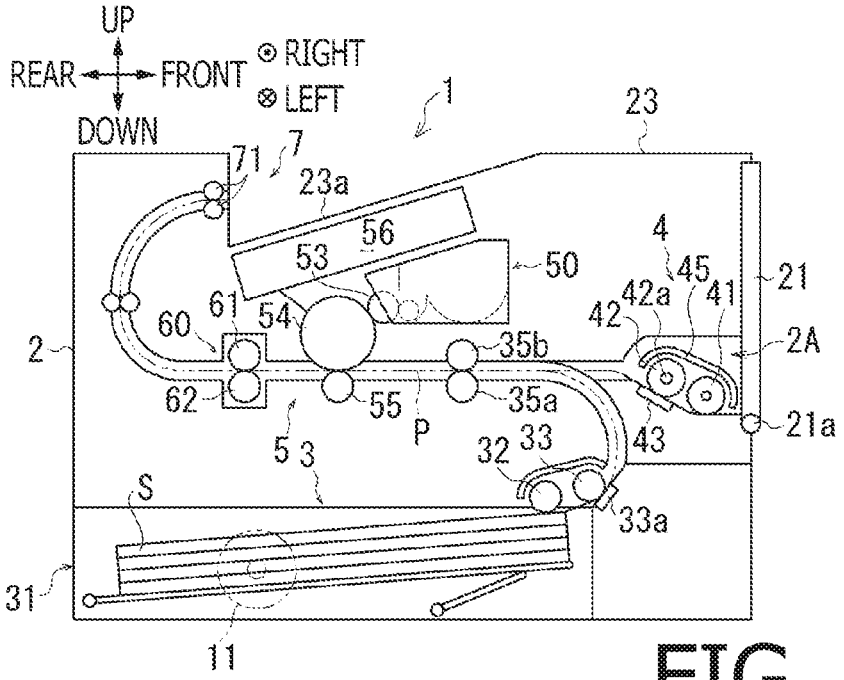
FIG. 1 is an illustrative cross-sectional view of an image forming apparatus with a sheet conveyer according to an embodiment of the present disclosure.

An image forming apparatus 1 includes, as shown in FIG. 1, a housing 2, an image forming unit 5, a sheet feeder 3, a sheet conveyer 4, and a motor 11. The image forming unit 5 may form an image on a sheet S. The sheet feeder 3 may feed sheets S to the image forming unit 5. The sheet conveyer 4 may convey manually inserted sheets toward the image forming unit 5. The motor 11 is a driving source to generate a driving force to drive movable devices in the image forming apparatus 1.

In the following description, directions related the image forming apparatus 1 and each part or item included in the image forming apparatus 1 will be mentioned on basis of a user's position to ordinarily use the image forming apparatus 1. For example, in FIG. 1, a viewer's right-hand side and left-hand will be referred to as the user's frontward side and rearward side, respectively. A viewer's nearer side and farther side in FIG. 1 will be referred to as a rightward side and a leftward side for the user to use the image forming apparatus 1, respectively. An up-to-down or down-to-up direction in FIG. 1 may be referred to as a vertical direction, and a front-to-rear or rear-to-front direction may be referred to as a front-rear direction. Further, a left-to-right or right-to-left direction may be referred to as a widthwise direction.

The housing 2 may be in a form of a rectangular box and accommodates the sheet feeder 3, the image forming unit 5, and a sheet ejector 7. The housing 2 includes an openable section 2A, which is a room open frontward, and a multi-purpose (MP) tray 21, which is swingable to cover or expose the openable section 2A. An upper part of the housing 2 is covered by an upper cover 23.

The MP tray 21 is swingable about a swing axis 21*a*, which is at a lower end of the MP tray 21 and extends horizontally along the widthwise direction. The MP tray 21 is swingable between a closure position, in which the MP tray 21 covers the openable section 2A, and an open position, in which the MP tray 21 exposes the openable section 2A. When the MP tray 21 is in the open position, sheets to be manually inserted may be placed on the MP tray 21. An upper face of the upper cover 23 is dented to form an ejection tray 23*a*, which inclines to be lower rearward and higher frontward.

The sheet feeder 3 includes a sheet cassette 31, a feeder roller 32, a separator roller 33, a separator pad 33*a*, and paired registration rollers 35*a*, 35*b*. Inside the housing 2, formed is a conveyer path P, which extends from the sheet cassette 31 through the image forming unit 5 to the ejection tray 23*a*.

The sheet cassette 31 may support one or more sheets S therein in a stack. The sheets S supported in the sheet cassette 31 may be fed by the feeder roller 32 toward the separator roller 33 and separated from one another by the separator roller 33 and the separator pad 33*a* to be conveyed in the conveyer path P one by one.

The sheets S fed in the conveyer path P may be further conveyed by the paired registration rollers 35*a*, 35*b*, which are located downstream along the conveyer path P from the separator roller 33, toward the image forming unit 5. The paired registration rollers 35*a*, 35*b* may stop a leading edge of the sheet S being conveyed for a short moment and resume conveyance of the sheet S at a predetermine timing to convey the sheet S toward a transfer position in the image forming unit 5.

The image forming unit 5 is arranged at an upper position with respect to the sheet cassette 31 and may form an image on a surface of the sheet S conveyed from the sheet feeder 3. The image forming unit 5 includes a process cartridge 50, an exposure unit 56, and a fuser unit 60. The process cartridge 50 may transfer an image on a surface of the sheet S being conveyed, the exposure unit 56 may expose the surface of the sheet S to light, and the fuser unit 60 may fix the image, which was transferred onto the sheet S in the process cartridge 50, thereon.

The process cartridge 50 includes a developer roller 53, a photosensitive drum 54, and a transfer roller 55.

The exposure unit 56 includes a laser diode, a polygon mirror, lenses, and reflector mirrors, which are not shown. The laser diode may emit a laser beam at a surface of the photosensitive drum 54 based on image data input to the image forming apparatus 1 so that the surface of the photosensitive drum 54 may be selectively exposed to the laser beam.

The photosensitive drum 54 is arranged in adjacent to the developer roller 53. The surface of the photosensitive drum 54 may be positively charged evenly by a charger, which is not shown, and may be selectively exposed to the laser beam in the exposure unit 56 according to the image data. Potential in the area exposed to the laser beam may be lowered to form an electrostatic latent image on the photosensitive drum 54. Thereafter, positively charged toner may be supplied to the electrostatic latent image on the photosensitive drum 54 by the developer roller 53 so that the electrostatic image may be developed to be a toner image.

The transfer roller 55 is arranged to face the photosensitive drum 54. A bias applier, which is not shown, may apply negative transferring bias to a surface of the transfer roller 55. The sheet may be conveyed through a transferring position between the transfer roller 55, of which surface is negatively biased, and the photosensitive drum 55, on which the developed toner image is carried, so that the toner image carried on the photosensitive drum 54 may be transferred to the surface of the sheet S.

The fuser unit 60 includes a heat roller 61 and a pressure roller 62. The heat roller 61 may rotate by the driving force from the motor 11 and may be heated by electricity supplied from an electric power source, which is not shown. The pressure roller 62 is arranged to face and contact the heat roller 61 and may be driven to rotate by rotation of the heat roller 61. As the sheet S with the transferred toner image thereon enters the fuser unit 60, the sheet S is conveyed through a position between the heat roller 61 and the pressure roller 62 so that the toner image may be fixed at the surface of the sheet S.

The sheet ejector 7 includes paired ejector rollers 71, 71 to eject the sheet S conveyed from the fuser unit 60 outside the housing 2. Specifically, the paired ejector rollers 71, 71 may further convey the sheet S conveyed from the fuser unit 60 to rest in the ejection tray 23*a* formed on the upper side of the upper cover 23.

Figure 2:
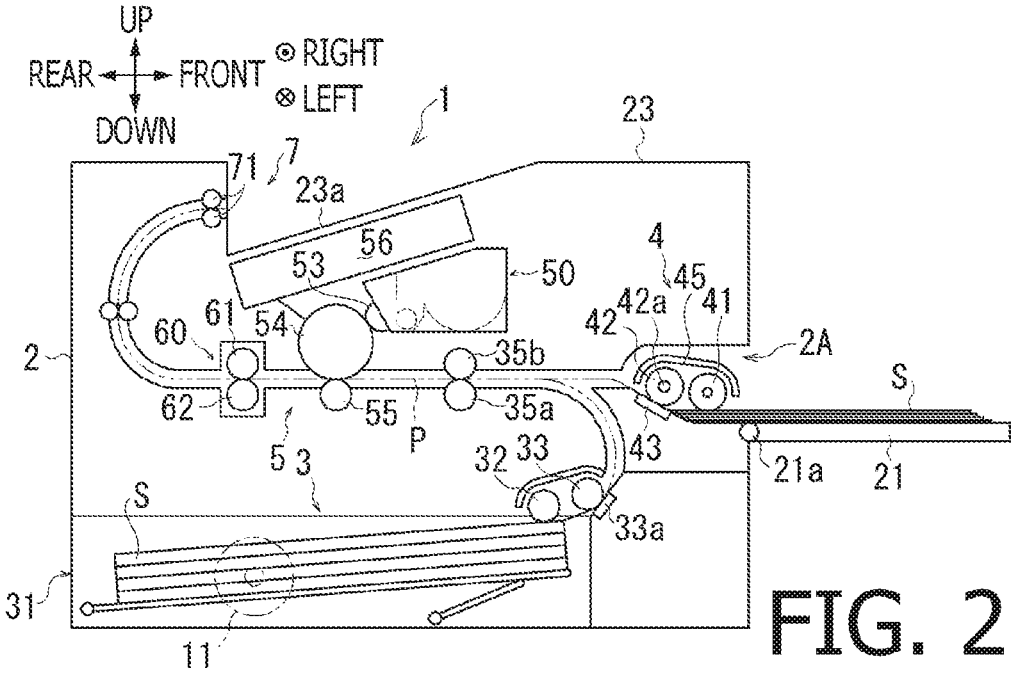
FIG. 2 is an illustrative cross-sectional view of the image forming apparatus with a multi-purpose (MP) tray being in an open position according to an embodiment of the present disclosure.

The sheet conveyer 4 is, as shown in FIG. 2, disposed in the openable section 2A to convey the sheets S inserted manually through the MP tray 21 toward the image forming unit 5.

[Sheet Conveyer]

Below will be described the sheet conveyer 4. The sheet conveyer 4 includes, as shown in FIG. 2, the MP tray 21, a pickup roller 41, a separator roller 42, a separator pad 43, the motor 11, and a roller holder 45. The MP tray 21 may support one or more sheets S thereon in a stack. The pickup roller 41 may contact the sheet S on the MP tray 21 and rotate to feed the sheet S to the separator roller 42. The separator roller 42 is arranged at a downstream position from the pickup roller 41 along a conveying direction for the sheet S to be conveyed. The separator pad 43 is arranged to face the separator roller 42. The motor 11 may supply a driving force to the pickup roller 41 and the separator roller 42. The roller holder 45 supports the pickup roller 41.

The separator roller 42 is rotatably supported by the housing 2 to rotate about a rotation shaft 42*a*, separate the sheets S fed by the pickup roller 41 from one another in conjunction with the separator pad 43, and convey the separated sheet S downstream in the conveying direction.

Figure 3:
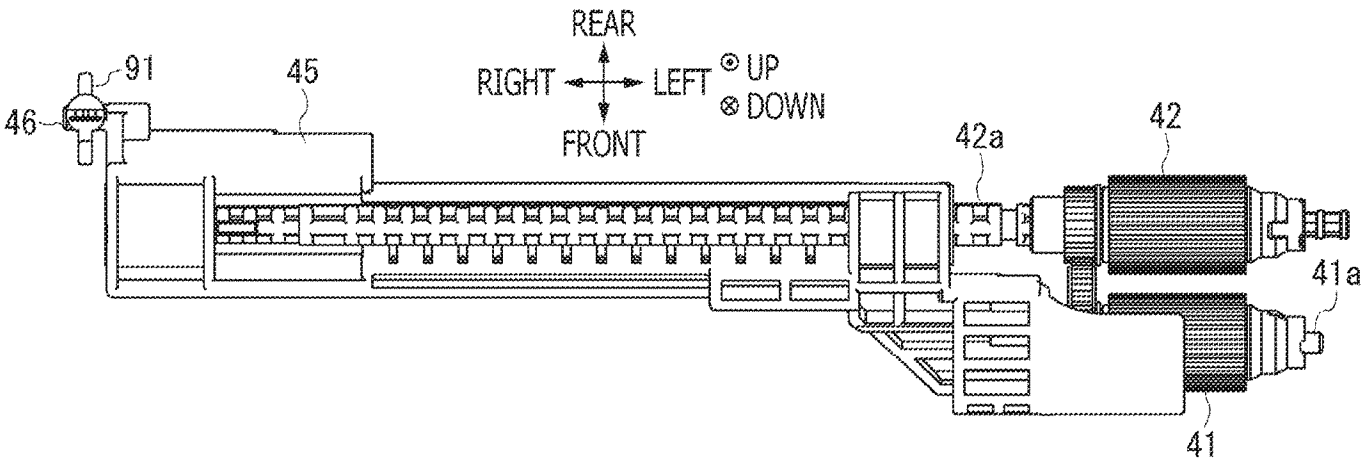
FIG. 3 is a plan view of a separator roller, a pickup roller, and a roller holder for the sheet conveyer according to the embodiment of the present disclosure.
Figure 4A:
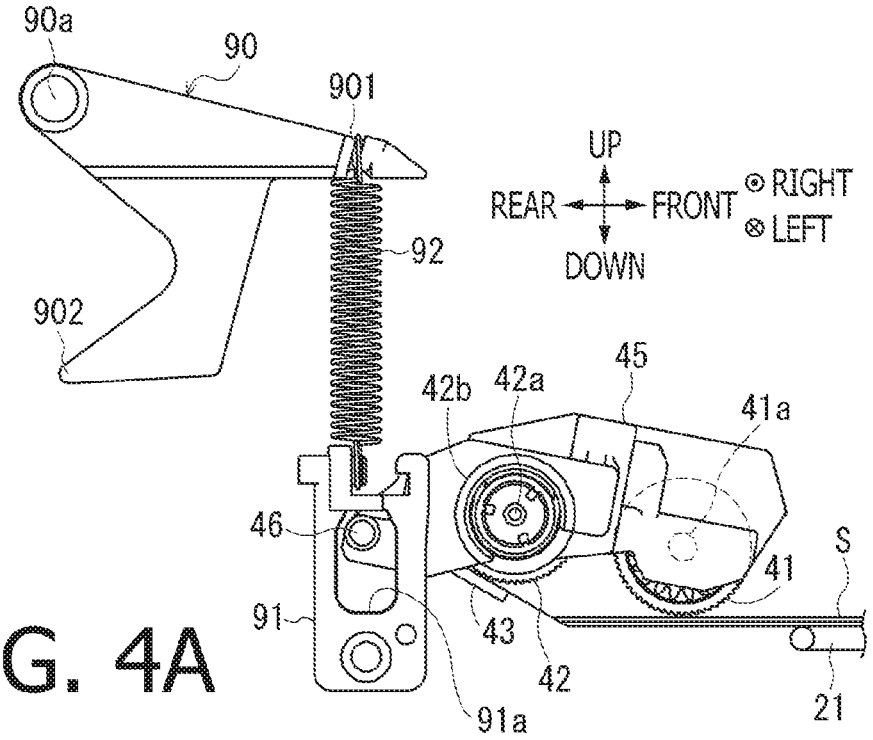
FIGS. 4A-4B are sideward views of the sheet conveyer toward the right according to the embodiment of the present disclosure with a load applier lever being in a second position and in a first position, respectively.
Figure 4B:
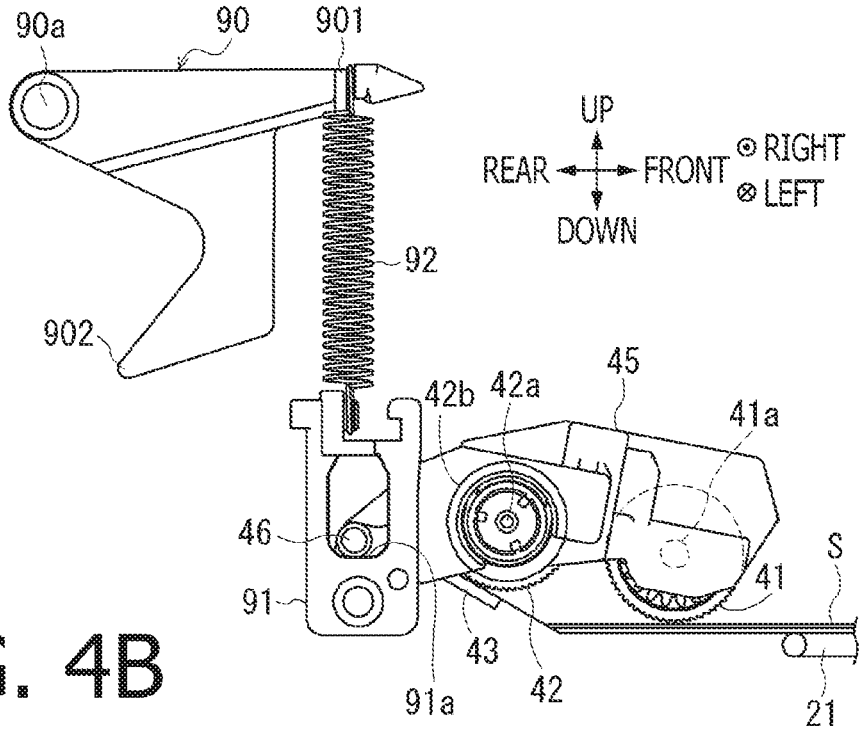

The roller holder 45 is, as shown in FIGS. 3 and 4A-4B, pivotably supported by the rotation shaft 42*a* of the separator roller 42 to pivot about the rotation shaft 42*a*. Further, the roller holder 45 supports the pickup roller 41 rotatably so that the pickup roller 41 may rotate about a rotation shaft 41*a* of the pickup roller 41. The roller holder 45 includes an arm 46, which is formed to protrude sideward along an axial direction of the rotation shaft 42*a* at a rearward position from the rotation shaft 42*a* of the separator roller 42.

The pickup roller 41 is located frontward from the rotation shaft 42*a* of the separator roller 42, and the arm 46 is located rearward from the rotation shaft 42*a*. In other words, the pickup roller 41 and the arm 46 are located on opposite sides to each other across the rotation shaft 42*a*. The roller holder 45 supports, at an intervening position between the arm 46 and the pickup roller 41, the separator roller 42 rotatably so that the separator roller 42 may rotate about the rotation shaft 42*a*. As the roller holder 45 pivots about the rotation shaft 42*a* of the separator roller 42, the pickup roller 41 and the arm 46 pivot about the rotation shaft 42*a* integrally along with the roller holder 45.

The pickup roller 41 and the separator roller 42 are arranged at a widthwise central area in the sheet conveyer 4. The rotation shaft 42*a* of the separator roller 42 is elongated in either rightward or leftward (e.g., rightward) along the widthwise direction to reach a rightward end area or a leftward end area of the sheet conveyer 4. The arm 46 is formed at a rightward end area or the leftward end area of the roller holder 45 (e.g., on the rightward end area), on the side where the rotation shaft 42*a* extends.

The pickup roller 41 rotatable about the rotation shaft 42*a* may pivot downward due to a weight thereof by an effect of gravity, when substantially no external force is applied to the roller holder 45, and contact the sheet S supported by the MP tray 21. On the other hand, when the arm 46 is subjected to a load that may lift the arm 46 upward, the roller holder 45 is subjected to a force that may act in a direction to pivot the pickup roller 41 downward. Thus, the pickup roller 41 may be pressed against the sheet S supported by the MP tray 21.

The sheet conveyer 4 includes an engagement member 91, which is engageable with the arm 46, and a load applier lever 90, which is coupled with the engagement member 91 through a first urging member 92. The first urging member 92 is coupled with the load applier 90 at a first end, e.g., an upper end in FIG. 4, and with the engagement member 91 at a second end, e.g., a lower end in FIG. 4. The load applier lever 90 is pivotable about a pivot axis 90*a*. Pivoting behaviors of the load applier lever 90 about the pivot axis 90*a* may move a connector section 901, at which the engagement member 91 is coupled with the load applier lever 90 through the first urging member 92, vertically. The connector section 901 is movable between a first position, which is upward as shown in FIG. 4B, and a second position, which is downward as shown in FIG. 4A.

The engagement member 91 includes an engageable section 91*a*, which is arranged at a lower position with respect to the arm 46 and is engageable with the arm 46. When the load applier lever 90 pivots to move the connector section 901 upward to the first position, the engagement member 91 likewise moves upward, and the engageable section 91*a* is engaged with the arm 46. In this condition, the first urging member 92 may be expanded to be longer than a length in a natural state, and the engagement member 91 coupled with the load applier lever 90 through the first urging member 92 is urged upward by an urging force of the first urging member 92. Therefore, a load to move the arm 46 upward may be applied by the engagement member 91 to the arm 46.

Thus, the load applier lever 90 being at the first position may support the first end of the first urging member 92 at a position, in which the first urging member 92 is deformed from the length of the natural state to urge the engagement member 91, connected to the second end of the first urging member 92, against the arm 46, so that the engagement member 91 may apply a load, which may act in a direction to urge the pickup roller 41 against the sheet S, to the arm 46.

When the load to act in the direction to move the arm 46 vertically is applied to the arm 46 of the roller holder 45, the roller holder 45 is subjected to a force that may act in the direction to move the pickup roller 41 further downward; therefore, the pickup roller 41 is pressed against the sheet S supported by the MP tray 21.

On the other hand, when the load applier lever 90 pivots to move the connector section 901 downward to the second position, the engagement member 91 is separated from the arm 46. In the state where the engageable section 91*a* is separated from the arm 46, substantially no load may be applied by the engagement member 91 to the arm 46, and the first urging member 92 may be in the natural length thereof.

Thus, the load applier lever 90 being in the second position may support the first end of the first urging member 92 at a position, in which the first urging member 92 is in the natural length thereof without urging the engagement member 91, connected to the second end of the first urging member 92, so that the engagement member 91 may not apply the load, which may act in the direction to urge the pickup roller 41 against the sheet S, to the arm 46.

The load applier lever 90 being in the second position may cause the arm 46 to be separated from the engageable section 91*a* of the engagement member 91. Therefore, for example, when the pickup roller 41 is placed to contact an upper surface of the MP tray 21 merely by the weight thereof, the pickup roller 41 may be lifted upward manually to be separated from the MP tray 21, and the sheets S to be placed on the MP tray 21 may be inserted in a position between the MP tray 21 and the pickup roller 41 easily.

In other words, a separated distance between the arm 46 and the engageable section 91*a* when the load applier lever 90 is in the second position may be set at an extent, which may allow the pickup roller 41 to move in a direction to be separated from the MP tray 21 to accept the sheets S to be inserted between the MP tray 21 and the pickup roller 41.

The load applier lever 90 is thus pivotable between the first position, in which the load applier lever 90 supports the first end of the first urging member 92 to be deformed from the natural length to urge the engagement member 91 connected to the second end of the first urging member 92 against the arm 46, so that the engagement member 91 may apply the load, which may act in the direction to urge the pickup roller 41 against the sheet S, to the arm 46; and the second position, in which the first urging member 92 is in the natural length thereof without urging the engagement member 91 connected to the second end of the first urging member 92 against the arm 46 so that the engagement member 91 may not apply the load, which may act in the direction to urge the pickup roller 41 against the sheet S, to the arm 46.

[Mode-Switching Device in the Sheet Conveyer]

The sheet conveyer 4 includes a mode-switching device to switch operation modes of the sheet conveyer 4 between a first mode and a second mode. The first mode may include a mode, in which the load applier lever 90 is moved to the second position to place the pickup roller 41 to contact the sheet S by the weight thereof, and the driving force from the motor 11 is not transmitted to the separator roller 42. The second mode may include a mode, in which the load applier lever 90 is moved to the first position to place the pickup roller 41 to be pressed against the sheet S by the load from the load applier lever 90 through the arm 46, and the driving force from the motor 11 is transmitted to the separator roller 42.

As shown in FIGS. 5A-5B through 7A-7B, the mode-switching device includes the load applier lever 90, the first urging member 92, the engagement member 91, a driving gear 80, a clutch member 81, a switching lever 93, a mode-switching gear 82, a lock lever 94, a solenoid 95, and a third urging member 96. The driving gear 80 may be driven by the driving force from the motor 11. The clutch member 81 is arranged between the driving gear 80 and the separator roller 42. The switching lever 93 is engageable with the clutch member 81. The mode-switching gear 82 may mesh with the driving gear 80. The lock lever 94 may mesh with the mode-switching gear 82. The solenoid 95 may move the lock lever 94. The third urging member 96 may urge the mode-switching gear 82 along a rotating direction.

The driving gear 80 is rotatable about a rotation shaft 80*a*. The driving gear 80 may be driven by the driving force from the motor 11 to transmit the driving force to the separator roller 42. The driving force transmitted to the separator roller 42 may further be transmitted by a gear system, which is arranged between the separator roller 42 and the pickup roller 41, to the pickup roller 41.

The clutch member 81 may switch states of transmission to transmit the driving force from the motor 11 to the separator roller 42 between a transmittable state, in which the driving force is transmittable to the separator roller 42, and a disconnected state, in which the driving force is not transmitted to the separator roller 42.

Figure 8:
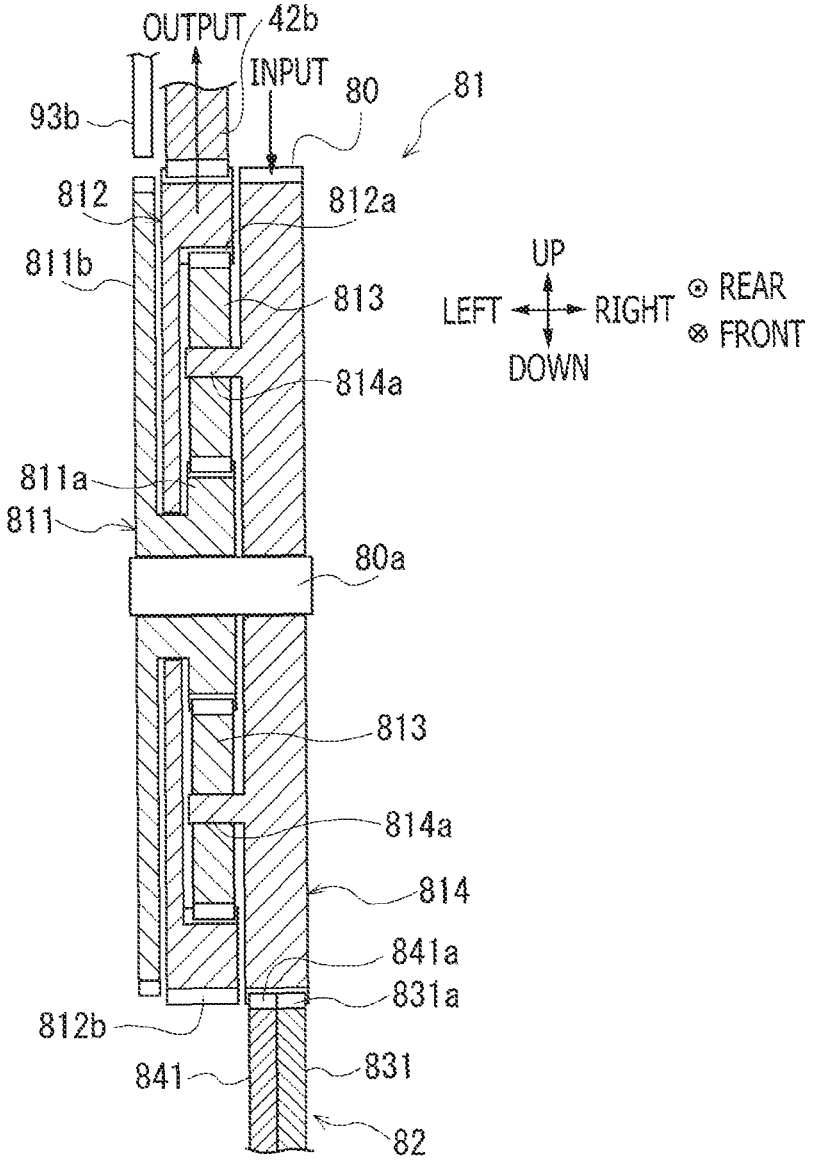
FIG. 8 is a cross-sectional view of a clutch member toward the rear according to the embodiment of the present disclosure viewed from the rear.

As shown in FIG. 8, the clutch member 81 includes a sun gear 811, a ring gear 812, planet gears 813, 813, a carrier 814. The sun gear 811 is rotatable about the rotation shaft 80*a* of the driving gear 80 and includes a gear section 811*a*. The ring gear 812 is rotatable about the rotation shaft 80*a*. The ring gear 812 includes inward teeth 812*a*, which are on an inner circumference of the ring gear 812. The ring gear 812 is rotatable relatively to the sun gear 811. The planet gears 813, 813 are arranged between the gear section 811*a* of the sun gear 811 and the inward teeth 812*a* of the ring gear 812 to mesh with both the gear section 811*a* and the inward teeth 812*a*. The carrier 814 is formed integrally with the driving gear 80 to rotate about the rotation shaft 80*a*. The carrier 814 supports the planet gears 813, 813 rotatably and revolvably so that each planet gear 813 may rotate about a rotation axis thereof and revolve around the rotation shaft 80*a* of the driving gear 80. The carrier 814 may rotate relatively to the sun gear 811 and the ring gear 812.

The sun gear 811 includes a lock-gear section 811*b*, which is integrally rotatable with the gear section 811*a*. The ring gear 812 is formed to have an output gear 812*b* on an outer circumference thereof. The output gear 812*b* is meshed with a separator roller gear 42*b*, which is rotatable about the rotation shaft 42*a* of the separator roller 42 to rotate integrally with the separator roller 42. The carrier 814 is formed to have support shafts 814*a*, which rotatably support the planet gears 813, 813. The support shafts 814*a* are rotational axes of the planet gears 813, 813.

The sun gear 811, the ring gear 812, the planet gears 813, 813, and the carrier 814 form a planetary differential gear system in the clutch member 81. The sun gear 811 is rotatable but may be restricted from rotating by an external force applied to the lock-gear section 811*b*. While the sun gear 811 is restricted from rotating the carrier 814 may rotate integrally with rotation of the driving gear 80. When the carrier 814 rotates integrally with the driving gear 80, the planet gears 813, 813 meshed with the gear section 81*a* of the sun gear 811 may rotate about the support shafts 814*a*, 814*a* and revolve around the rotation shaft 80*a*. Thereby, the ring gear 812, with the inward teeth 812*a* meshed with the planet gears 813, 813, may rotate about the rotation shaft 80*a*.

In other words, in the state where the sun gear 811 is stationary, rotation of the driving gear 80 may cause the ring gear 812 to rotate, and the separator roller gear 42*b* meshed with the output gear 812*b* of the ring gear 812 may be rotated. In this state, the clutch member 81 is placed in the transmittable state, in which the driving force from the motor 11 is transmitted from the driving gear 80 to the separator roller 42 through the separator roller gear 42*b*.

On the other hand, in the state where the sun gear 811 is rotatable without restriction, the carrier 814 may still rotate integrally with the rotation of the driving gear 80, and the planet gears 813, 813 may rotate about the support shafts 814*a*, 814*a* and revolve around the rotation shaft 80*a*. In this regard, the output gear 812*b* of the ring gear 812 meshed with the separator roller gear 42*b* is subjected to a load that may act in the rotating direction, while the sun gear 811 is free from the load acting in the rotating direction. Therefore, the sun gear 811 with the gear section 811*a* meshed with the planet gears 813, 813 may rotate while the ring gear 812 may be maintained stationary without rotating.

Thus, when the sun gear 811 is rotatable, rotation of the driving gear 80 may not cause the ring gear 812 to rotate, and the separator roller 42 is not driven. In other words, the clutch member 81 is placed in the disconnected state, in which the driving force from the motor 11 is not transmitted from the driving gear 80 to the separator roller 42.

The switching lever 93 is pivotable about a pivot axis 93*a* and includes an interlocking section 93*b*, which may engage with the lock-gear section 811*b* of the sun gear in the clutch member 81. The switching lever 93 may pivot about the pivot axis 93*a* to move between a third position, in which the interlocking section 93*b* is engaged with the lock-gear section 811*b*, and a fourth position, in which the interlocking section 93*b* is disengaged from the lock-gear section 811*b*.

The switching lever 93 being located at the third position causes the interlocking section 93*b* to be engaged with the lock-gear section 811*b* and the sun gear 811 in the clutch member 81 to be restricted from rotating. Therefore, the switching lever 93 in the third position may place the clutch member 81 in the transmittable state. The switching lever 93 being located at the fourth position causes the interlocking section 93*b* to be disengaged from the lock-gear section 811*b* and the sun gear 811 in the clutch member 811 to be rotatable. Therefore, the switching lever 93 in the fourth position may place the clutch member 81 in the disconnected state, in which transmission of the driving force from the driving gear 80 is discontinued.

The mode-switching device further includes a torsion spring 931, which may urge the switching lever 93 toward a position, in which the interlocking section 93*b* is interlocked with the lock-gear section 811*b*. When substantially no external force in the rotating direction is applied to the switching lever 93, the switching lever 93 is placed in the third position, in which the interlocking section 93*b* is interlocked with the lock-gear section 811*b*, by an urging force of the torsion spring 931.

Figure 9A:
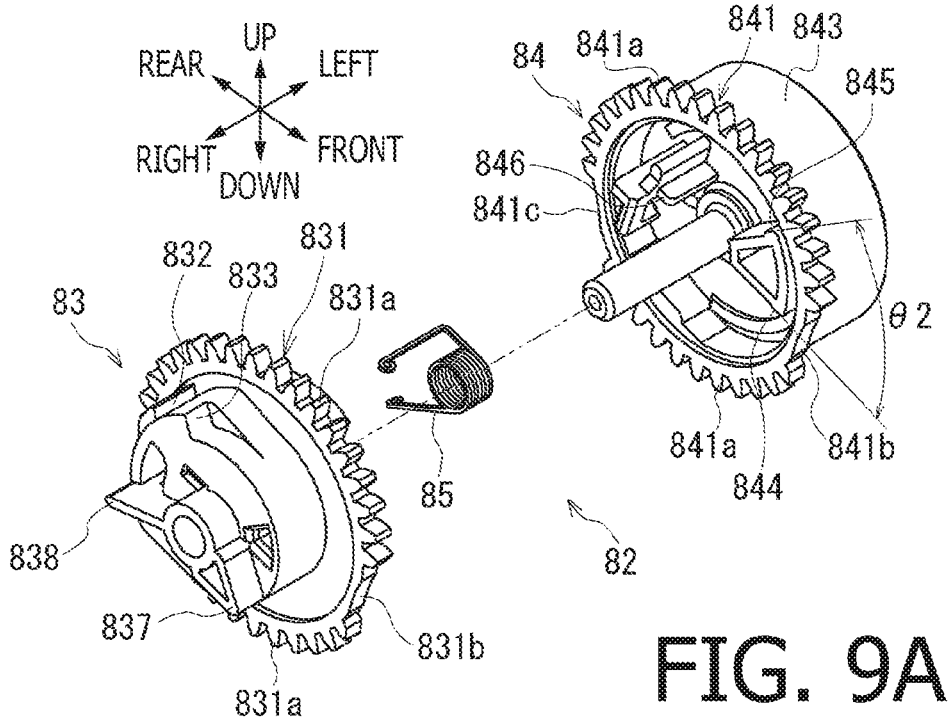
FIGS. 9A-9B are exploded perspective views of the mode-switching gear for the sheet conveyer according to the embodiment of the present disclosure viewed from a rightward upper-front position and a leftward upper-front position, respectively.
Figure 9B:
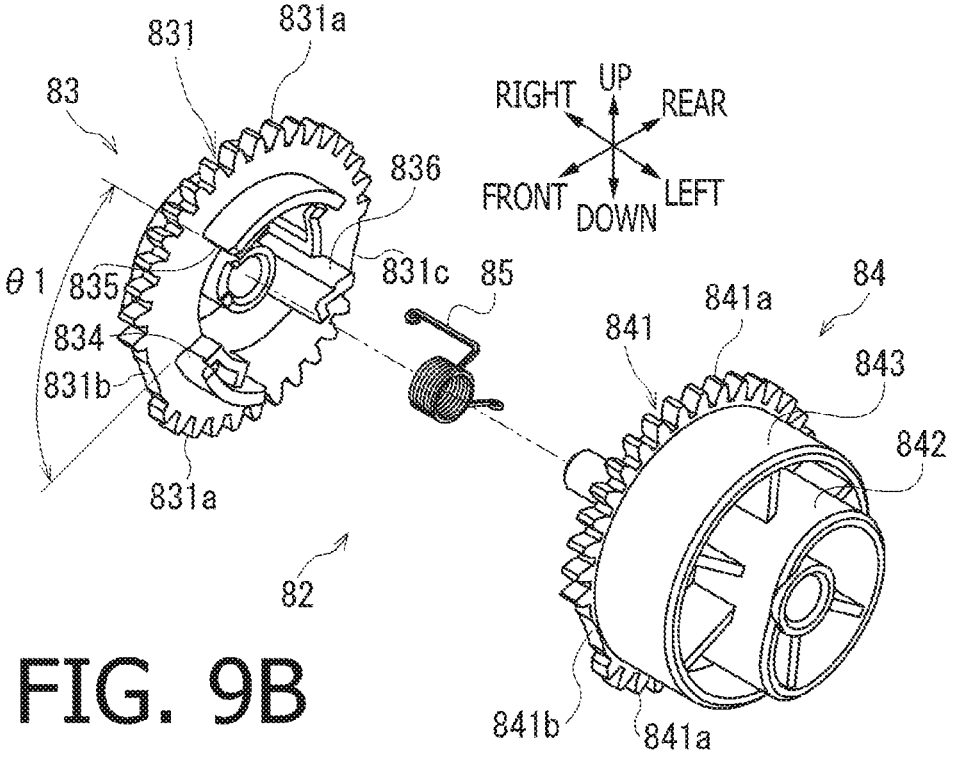

As shown in FIGS. 9A-9B, the mode switching gear 82 in the mode-switching device includes a first gear 83, a second gear 84, and a second urging member 85. The first gear 83 includes a first gear section 831, a first lock-engageable section 832, and a second lock-engageable section 833. The first gear section 831 includes first teethed sections 831*a*, which may mesh with the driving gear 80, a first no-tooth section 831*b*, in which no meshing tooth is formed, and a second no-tooth section 83*c*, which is formed at a phase different from the first no-tooth section 831*b*. The first lock-engageable section 832 and the second lock-engageable section 833 are rotatable integrally with the first gear section 831.

When the first gear 83 is at a rotational position, in which one of the first teethed sections 831*a* is located to coincide with the driving gear 80, the first teethed section 831*a* may mesh with the driving gear 80. When the first gear 83 is at another rotational position, in which either the first no-tooth section 831*b* or the second no-tooth section 83*c* is located to coincide with the driving gear 80, the first gear 83 does not mesh with the driving gear 80. The first gear 83 may rotate, for example, clockwise in FIG. 5A when the first teethed section 831 is meshed with the driving gear 80. In the following description, the rotating direction of the first gear 83, which may be rotated by the driving gear 80 when the driving gear 80 meshes with the first teethed section 831*a*, will be recited as a first rotating direction.

The second gear 84 includes a second gear section 841, a first cam section 842, and a second cam section 843. The second gear section 841 includes second teethed sections 841*a*, which may mesh with the driving gear 80, a third no-tooth section 841*b*, in which no meshing tooth is formed, and a fourth no-tooth section 84*c*, which is formed at a phase different from the third no-tooth section 841*b*. The first cam section 842 may contact the load applier lever 90 to move the load applier lever 90 between the first position and the second position. The second cam section 843 may contact the switching lever 93 and move the switching lever 93 between the third position and the fourth position. The second gear 84 is rotatable about a rotation axis of the first gear 83 and may turn about the rotation axis of the first gear 83 relatively to the first gear 83 within a predetermined angle range.

When the second gear 84 is at a rotational position, in which the second teethed section 841*a* is located to coincide with the driving gear 80, the second teethed section 841 may mesh with the driving gear 80. When the second gear 84 is at another rotational position, in which either the first no-tooth section 841*b* or the second no-tooth section 84*c* is located to coincide with the driving gear 80, the second gear 84 does not mesh with the driving gear 80. The second gear 84 with the second toothed section 841*a* being meshed with the driving gear 80 may rotate in the first rotating direction.

The first gear 83 and the second gear 84 area arranged alongside each other along the rotation axis thereof, in an arrangement such that the second teethed sections 841*a*, the third no-tooth section 841*b*, and the fourth no-tooth section 84*c* of the second gear 84 correspond to the first teethed sections 831*a*, the first no-tooth section 831*b*, and the second no-tooth section 83*c* of the first gear 83, respectively. The first lock-engageable section 832 and the second lock-engageable section 833 are formed on a side of the first gear 83 opposite to a side that faces toward the second gear 84. In other words, the first lock-engageable section 832 and the second lock-engageable section 833 may be formed on a rightward side of the first gear 83. The first cam section 842 and the second cam section 843 are formed on a side of the second gear 84 opposite to a side that faces toward the first gear 83. In other words, the first cam section 842 and the second cam section 843 may be formed on a leftward side of the second gear 84.

On the side of the first gear 83 that faces toward the second gear 84, e.g., on the leftward side of the first gear 83, formed are engageable edges 834, 835, which are arranged at different phases to be separated from each other at a predetermined angle θ1. On the side of the second gear 84 that faces toward the first gear 83, e.g., on the rightward side of the second gear 84, formed are engageable blocks 844, 845, which are arranged at different phases to be separated from each other at another predetermine angle θ2. The angle θ2 is smaller than the angle θ1.

The first gear 83 and the second gear 84 are arranged to face each other in an arrangement such that the engageable blocks 844, 845 in the second gear 84 are located between the engageable edge 834 and the engageable edge 835 in the first gear 83; and that the engageable edge 834 in the first gear 83 and the engageable block 844 in the second gear 84 face each other along the rotating direction, and the engageable edge 835 in the first gear 83 and the engageable block 845 in the second gear 84 face each other along the rotating direction.

The second gear 84 may turn relatively to the first gear 83 within a range between a rotational position, in which the engageable edge 834 and the engageable block 844 contact each other while the engageable edge 835 and the engageable block 845 are separated from each other; and another rotational position, in which the engageable edge 835 and the engageable block 845 contact each other while the engageable edge 834 and the engageable block 844 are separated from each other.

The former rotational position, in which the engageable edge 834 and the engageable block 844 contact each other, and the latter rotational position, in which the engageable edge 835 and the engageable 845 contact each other, are at different phases apart from each other for a rotational amount equivalent to a predetermined quantity of teeth. For example, the second gear 84 may turn relatively to the first gear 83 within a range, in which the first teethed section 831*a* in the first gear 83 and the second teethed section 841*a* in the second gear 84 are separable from each other for a rotational amount equivalent to two (2) teeth.

The second urging member 85 is interposed between the first gear 83 and the second gear 84 to urge the second gear 84 relatively against the first gear 83 in a direction to cause the engageable edge 834 in the first gear 83 and the engageable block 844 in the second gear 84 to contact each other. The second urging member 83 may be a torsion spring and interposed in a compressed condition between an engageable block 836 formed in the first gear 83 and an engageable block 846 formed in the second gear 84 so that the second gear 84 may be urged relatively to the first gear 83 in the direction to cause the engageable edge 834 and the engageable block 844 to contact each other. In other words, the second urging member 85 may urge the second gear 84 against the first gear 83 in the first rotating direction.

The first gear 83 and the second gear 84 are formed to have the first teethed sections 831*a*, the first no-tooth section 831*b*, and the second no-tooth section 831*c*; and the second teethed sections 841*a*, the third no-tooth section 841*b*, and the fourth no-tooth section 84*c*, respectively, in such an arrangement that phases of the first teethed section 831*a*, the first no-tooth section 831*b*, and the second no-tooth section 83*c* in the first gear 83 coincide with phases the second teethed section 841*a*, the third no-tooth section 841*b*, and the fourth no-tooth section 84*c* in the second gear 84, respectively, when the first gear 83 and the second gear 84 are in a rotational phase where the engageable edge 834 and the engageable block 844 contact each other.

Meanwhile, the load applier lever 90 includes a contact section 902 (see FIG. 5B), at which the load applier lever 90 may contact the first cam section 842. The load applier lever 90 tends to, in a natural state where substantially no external force is applied thereto, pivot in a direction to be closer to the arm 46 due to weights of the engagement member 91 and the first urging member 92 connected to the connector section 901. The load applier lever 90 is in a configuration such that a pivoting behavior of the connector section 901 in the direction to be closer to the arm 46 may cause the contact section 902 to move closer to the first cam section 842 and contact the first cam section 842. The contact of the contact section 902 with the first cam section 842 may restrict the load applier lever 90 from further pivoting. Thus, the connector section 901 may stay at a predetermined pivoted position.

The second gear 84 may rotate while the contact section 902 is in contact with the first cam section 841. As the second gear 84 rotates, the contact section 902 may move along an outline of the first cam section 842, and the load applier lever 90 may move between the first position and the second position.

For example, when the second gear 84 is in a rotational position, in which the third no-tooth section 841*b* is located to coincide with the driving gear 80, the load applier lever 90 may be moved by the first cam section 842 to the second position. When the load applier lever 90 is in the second position, the arm 46 may be separated from the engageable section 91*a* in the engagement member 91 for the predetermined distance. Thus, the arm 46 may be released from the load from the load applier lever 90 that may act in the direction to urge the pickup roller 41 against the sheet S, and the pickup roller 41 may merely contact the sheet S due to the weight thereof.

On the other hand, when the second gear 84 is in a rotational position, in which the fourth no-tooth section 84*c* is at a position to coincide with the driving gear 80, the load applier lever 90 may be moved by the first cam section 842 to the first position. When the load applier lever 90 is in the first position, the arm 46 may engage with the engageable section 91*a* in the engagement member 91. Thus, the engagement member 91 may apply the load that may act in the direction to press the pickup roller 41 against the sheet S to the arm 46, and the pickup roller 41 may be pressed against the sheet S.

Meanwhile, the switching lever 93 includes a contact section 93*c* (see FIG. 5B), at which the switching lever 93 may contact the second cam section 843. The contact section 93*c* is urged by a torsion spring 931 in a direction to tend to contact the second cam section 843. The contact of the contact section 93*c* with the second cam section 843 may restrict the switching lever 93 from further pivoting. Thus, the switching lever 93 may stay at a predetermined pivoted position.

The second gear 84 may rotate while the contact section 93*c* is in contact with the second cam section 843. As the second gear 84 rotates, the contact section 93*c* may move along an outline of the second cam section 843, and the switching lever 93 may move between the third position and the fourth position.

For example, when the second gear 84 is at a rotational position, in which the third no-tooth section 841*b* is located to coincide with the driving gear 80, the switching lever 93 may be moved by the second cam section 843 to the fourth position, in which the clutch member 81 is in the disconnected state.

On the other hand, when the second gear 84 is at a rotational position, in which the fourth no-tooth section 84*c* is located to coincide with the driving gear 80, the switching lever 93 may be moved by the second cam section 843 to the third position, where the clutch member 81 is placed in the transmittable state.

Thus, the sheet conveyer 4 is operable in the first mode, in which the second gear 84 is at the rotational position where the third no-tooth section 841*b* is located to coincide with the driving gear 80, the load applier lever 90 is moved by the first cam section 842 to the second position, the pickup roller 41 contacts the sheet S due to the weight thereof, and the switching lever 93 is moved by the second cam section 843 to the fourth position, and the clutch member 81 is placed at the disconnected state; and in the second mode, in which the second gear 84 is at the rotational position where the fourth no-tooth section 84*c* is located to coincide with the driving gear 80, the load applier lever 90 is moved by the first cam section 842 to the first position, the pickup roller 41 is pressed against the sheet S by the load applied by the load applier lever 90 to the arm 46, the switching lever 93 is moved by the second cam section 843 to the third position, and the clutch member 81 is placed in the transmittable state.

The lock lever 94 is pivotable about a pivot axis 94*a* and includes a first locking section 941, which is engageable with the first lock-engageable section 832 in the first gear 83, and a second locking section 942, which is engageable with the second lock-engageable section 833 in the first gear 83. The first locking section 941 is engageable with the first lock-engageable section 832 when the first gear 83 is at the rotational position, in which the first no-tooth section 831*b* is located to coincide with the driving gear 80. The second locking section 942 is engageable with the second lock-engageable section 833 when the first gear 83 is at the rotational position, in which the second no-tooth section 83*c* is located to coincide with the driving gear 80.

The lock lever 94 may pivot about the pivot axis 94*a* between a first locking position and a second locking position. When the lock lever 94 is in the first locking position, the first locking section 941 is engaged with the first lock-engageable section 832, and the second locking section 942 is disengaged from the second lock-engageable section 833 so that the first gear 83 is maintained stationary at the rotational position where the first no-tooth section 831*b* is located to coincide with the driving gear 80. When the lock lever 94 is in the second locking position, the second locking section 942 engages with the second lock-engageable section 833, and the first locking section 941 is disengaged from the first lock-engageable section 832 so that the first gear 83 is maintained stationary at the rotational position, where the second no-tooth section 83*c* is located to coincide with the driving gear 80.

When the lock lever 94 is at the first locking position, in which the first gear 83 is maintained stationary at the rotational position where the first no-tooth section 831*b* is located to coincide with the driving gear 80, the first gear 83 does not mesh with the driving gear 80; therefore, while the first gear 83 is locked stationary by the lock lever 94, the driving gear 80 is rotatable. Meanwhile, when the lock lever 94 is at the second locking position, in which the first gear 83 is maintained stationary at the rotational position where the second no-tooth section 83*c* is located to coincide with the driving gear 80, the first gear 83 does not mesh with the driving gear 80; therefore, while the first gear 83 is locked stationary by the lock lever 94, the driving gear 80 is rotatable.

The solenoid 95 is connected with a connecting section 943, which is formed in the lock lever 94. In other words, the solenoid 95 is connected with the lock lever 94 at the connecting section 943. The solenoid 95 may expand or contract so that the expanding or contracting behavior of the solenoid 95 may cause the lock lever 94 to pivot about the pivot axis 94*a* between the first locking position and the second locking position. For example, when the solenoid 95 is inactivated and expands, the lock lever 94 may be located at the first locking position, and when the solenoid 95 is activated and contracts, the lock lever 94 may be located at the second locking position.

On the side of the first gear 83 opposite to the side that faces toward the second gear 84, formed are a first engagement block 837 and a second engagement block 838, which are engageable with the third urging member 96. The third urging member 96 may engage with the first engagement block 837 in the first gear 83 when the first gear 83 is at the rotational position, where the first no-tooth section 831*b* is located to coincide with the driving gear 80, to urge the first gear 83 in the first rotating direction.

While the third urging member 96 is engaged with the first engagement block 837 in the first gear 83, and when the lock lever 94 moves from the first locking position to the second locking position, the first locking section 941 is disengaged from the first lock-engageable section 832, and the first gear 83 is released to be movable from the rotational position where the first no-tooth section 831*b* is located to coincide with the driving gear 80 to rotate in the first rotating direction. The first gear 83 released to rotate may be moved by the urging force of the third urging member 96 to rotate to the rotational position, where one of the first teethed sections 831*a*, which is located behind from the first no-tooth section 831*b* along the first rotating direction, may mesh with the driving gear 80.

In other words, the third urging member 96 may urge the first gear 83 to move from the position, where the first no-tooth section 831*b* is located to coincide with the driving gear 80, in the first rotating direction to the rotational position, where the first teethed section 831*a* may mesh with the driving gear 80.

Further, the third urging member 96 may engage with the second engagement block 838 in the first gear 83 when the first gear 83 is at the rotational position where the second no-toothed section 83*c* is located to coincide with the driving gear 80 to urge the first gear 83 in the first rotating direction.

While the third urging member 96 is engaged with the second engagement block 838 in the first gear 83, and when the lock lever 94 moves from the second locking position to the first locking position, the second locking section 942 is disengaged and separated from the second lock-engageable section 833, and the first gear 83 is released to be movable from the rotational position where the second no-tooth section 83*c* is located to coincide with the driving gear 80 to rotate in the first rotating direction.

The first gear 83 released to rotate may be moved by the urging force of the third urging member 96 to rotate to the rotational position, where the other one of the first teethed sections 831*a*, which is located behind from the second no-tooth section 83*c* along the first rotating direction, may mesh with the driving gear 80.

In other words, the third urging member 96 may urge the first gear 83 to move from the position, where the second no-tooth section 83*c* is located to coincide with the driving gear 80, in the first rotating direction to the rotational position, where the first teethed section 831*a* may mesh with the driving gear 80.

[Behaviors of the Sheet Conveyer]

The sheet conveyer 4 configured as described above may act as described below.

Figure 5A:
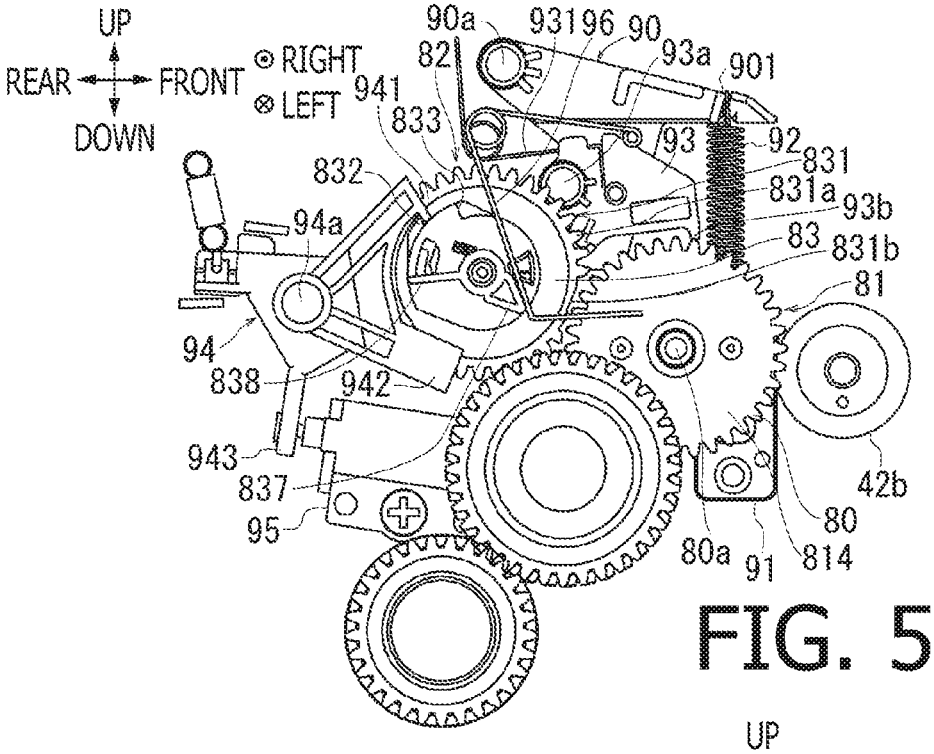
FIGS. 5A-5B are sideward views of a mode-switching gear for the sheet conveyer being an initial state toward the right and the left, respectively, according to the embodiment of the present disclosure.
Figure 5B:
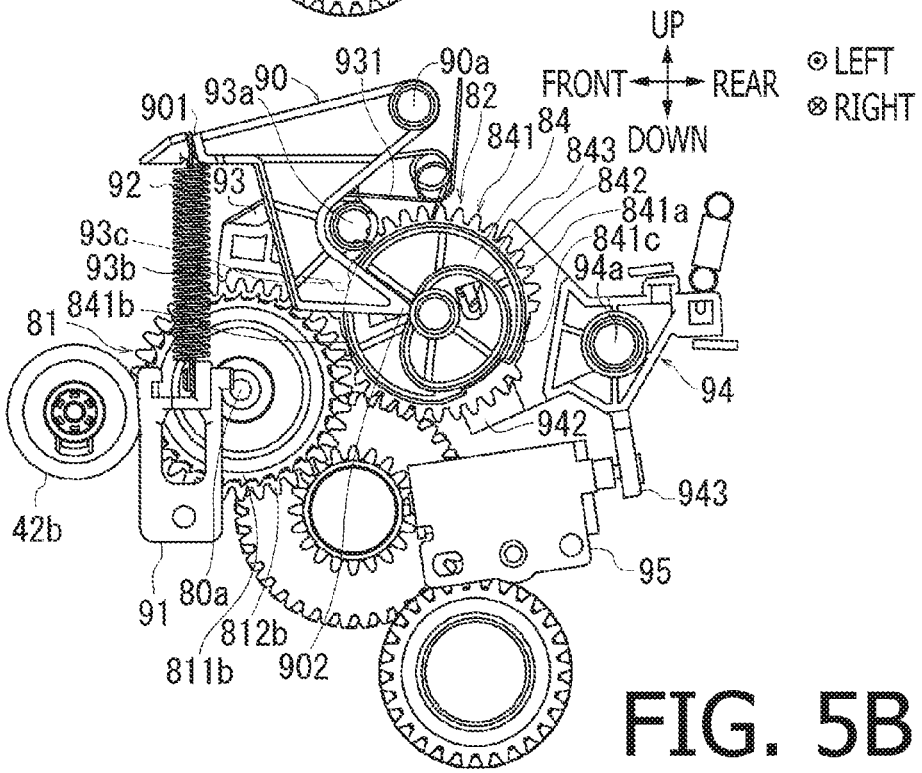
Figure 6:
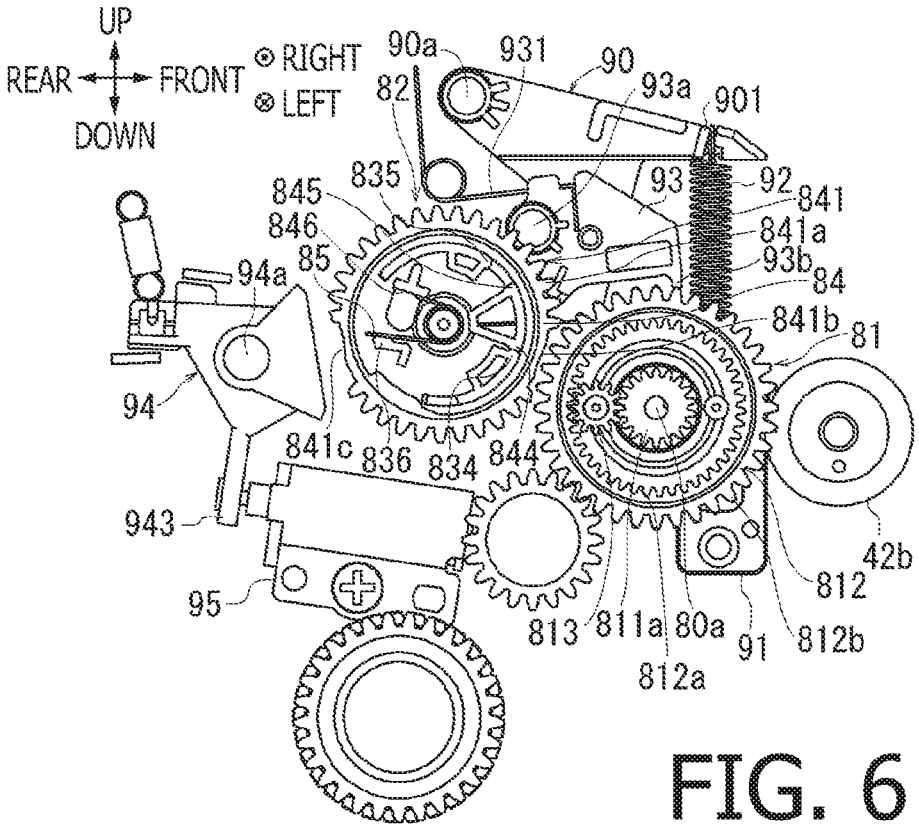
FIG. 6 is a cross-sectional view of the mode-switching gear for the sheet conveyer being in the initial state toward the right according to the embodiment of the present disclosure.
Figure 7A:
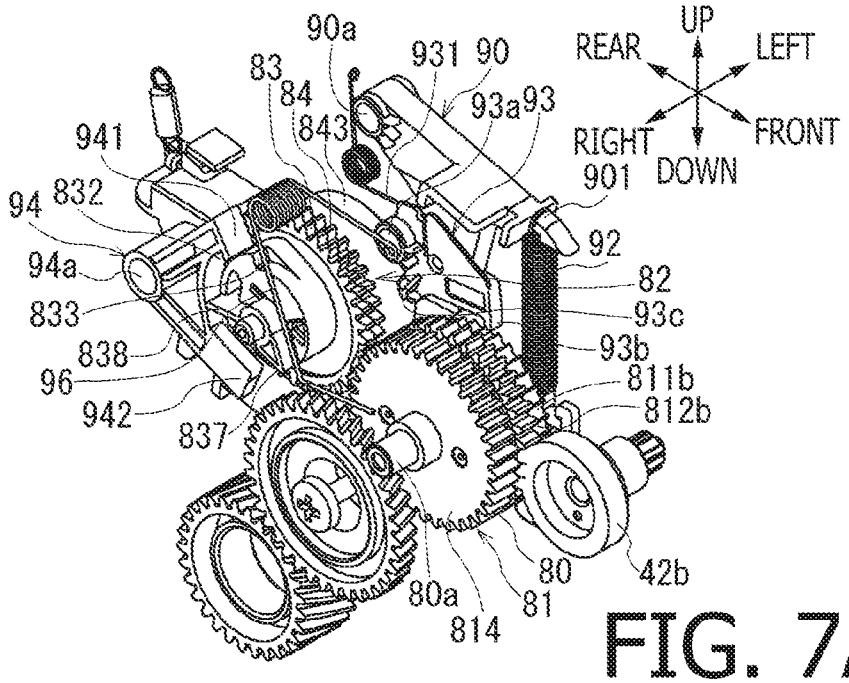
FIGS. 7A-7B are perspective views of the mode-switching gear for the sheet conveyer being in the initial state according to the embodiment of the present disclosure viewed from a rightward upper-front position and a leftward lower-rear position, respectively.
Figure 7B:
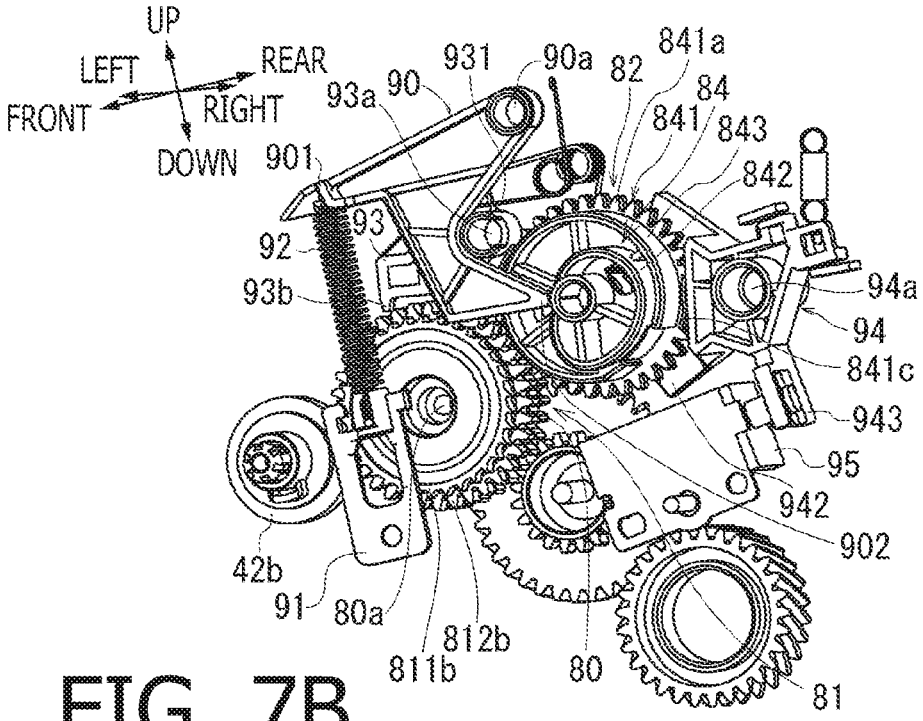

First, in an initial state as shown in FIGS. 5A-5B and 6, the solenoid 95 is inactivated to expand, the lock lever 94 is located at the first locking position, the first locking section 941 in the lock lever 94 engages with the first lock-engageable section 832 in the first gear 83, and the first gear 83 is maintained stationary at the rotational position where the first no-tooth section 831*b* is located at the position coincident with the driving gear 80.

In the initial state, neither of the first gear 83 nor the second gear 84 in the mode switching gear 82 meshes with the driving gear 80, which may be rotating by the driving force from the motor 11. Meanwhile, the switching lever 93 is at the fourth position, where the engagement section 93*b* is separated from the lock-gear section 811*b*, and where the clutch member 81 is in the disconnected state. Therefore, the driving force from the motor 11 is not transmitted from the driving gear 80 to the separator roller 42. In other words, neither the separator roller 42 nor the pickup roller 41 is driven.

Meanwhile, the load applier lever 90 is at the second position, where the engagement member 91 does not apply the load to the arm 46. Therefore, the pickup roller 41 may merely contact the sheet S on the MP tray 21 by the weight thereof. In this initial state, the first conveyer 4 is in the first mode.

In the first mode, the first gear 83 is urged by the third urging member 96 in a direction to cause the first locking section 941 to be engaged with the first lock-engageable section 832. Meanwhile, the second gear 84 is urged by the second urging member 85 to be located at the rotational position, where the engageable block 844 in the second gear 84 contacts the engageable edge 834 in the first gear 83. The urging direction to urge the second gear 84 relatively to the first gear 83 by the second urging member 85 may coincide with the direction, along which the engageable edge 834 in the first gear 83 and the engageable block 844 in the second gear 84 may contact each other, i.e., the first rotating direction.

From this state, the solenoid 95 may be activated to contract. The contracted solenoid 95 moves the lock lever 94 to the second locking position, and the first locking section 941 in the lock lever 94 is disengaged from the first lock-engageable section 832 in the first gear 83. Thus, the first gear 83 is released to be rotatable. The first gear 83, enabled to rotate and urged in the first rotating direction by the third urging member 96, starts rotating in the first rotating direction. Simultaneously, the second gear 84 urged in the first rotating direction by the second urging member 85 relatively to the first gear 83 starts rotating integrally with the first gear 83.

Figure 10A:
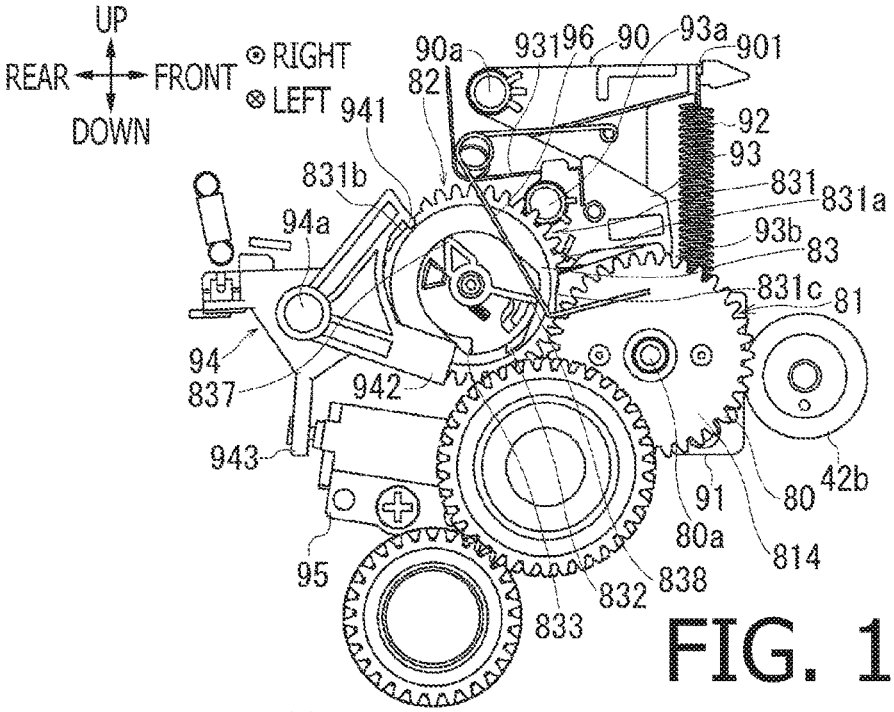
FIGS. 10A-10B are sideward views of the mode-switching gear for the sheet conveyer toward the right and the left, respectively, with a first gear and a second gear being rotated by a driving force from a driving gear according to the embodiment of the present disclosure.
Figure 10B:
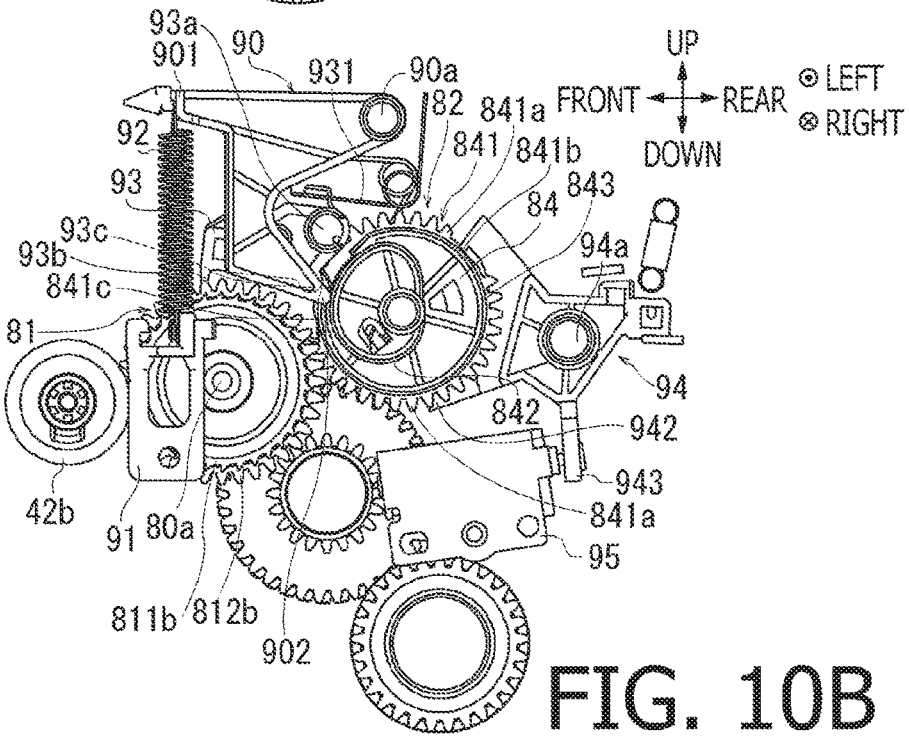
Figure 11:
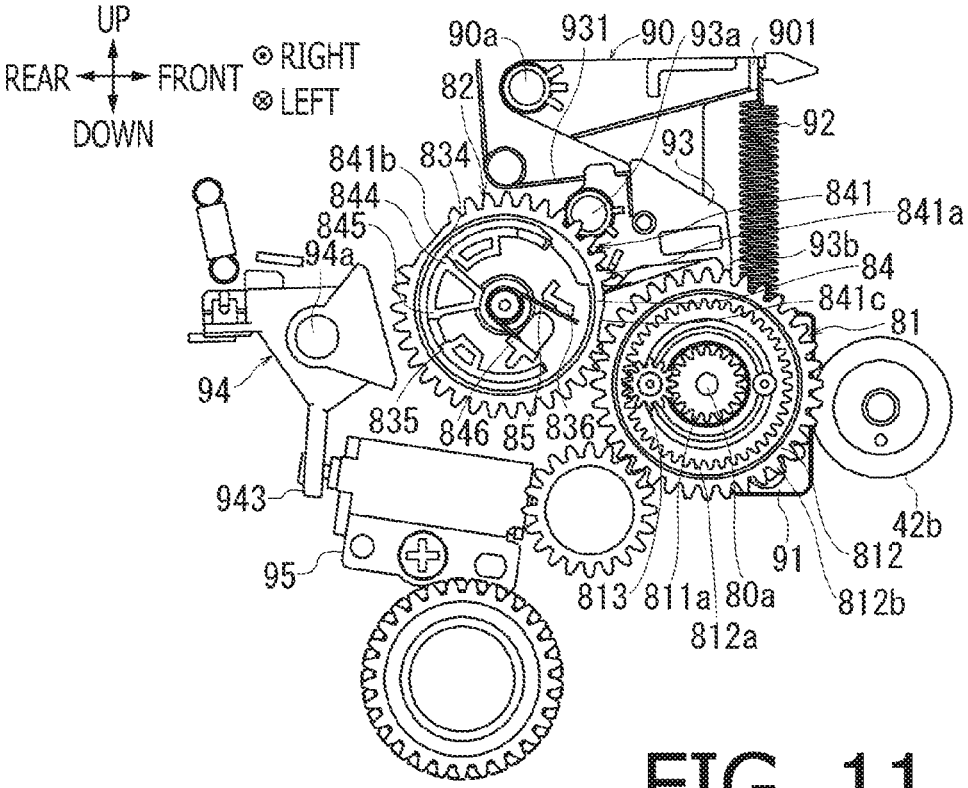
FIG. 11 is a cross-sectional view of the mode-switching gear for the sheet conveyer toward the right with the first gear and the second gear being rotated by the driving force from the driving gear according to the embodiment of the present disclosure.

As shown in FIGS. 10A-10B and 11, as the first gear 83 and the second gear 84 are rotated by the urging force from the third urging member 96, the first teethed section 831*a* in the first gear 83 and the second teethed section 841*a* in the second gear 84 mesh with the driving gear 80. Therefore, the first gear 83 and the second gear 84 are rotated by the driving force from the driving gear 80.

Figure 12A:
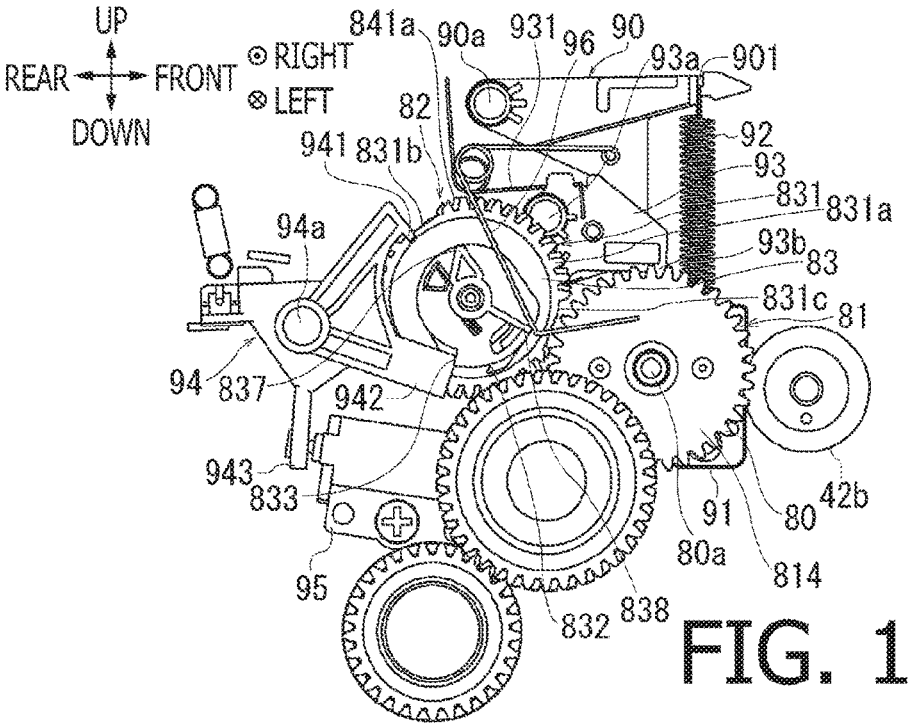
FIGS. 12A-12B are sideward views of the mode-switching gear for the sheet conveyer toward the right and the left, respectively, with the first gear and the second gear being at a rotational position where a second no-tooth section and a fourth no-tooth section are at a position coincident with the driving gear according to the embodiment of the present disclosure.
Figure 12B:
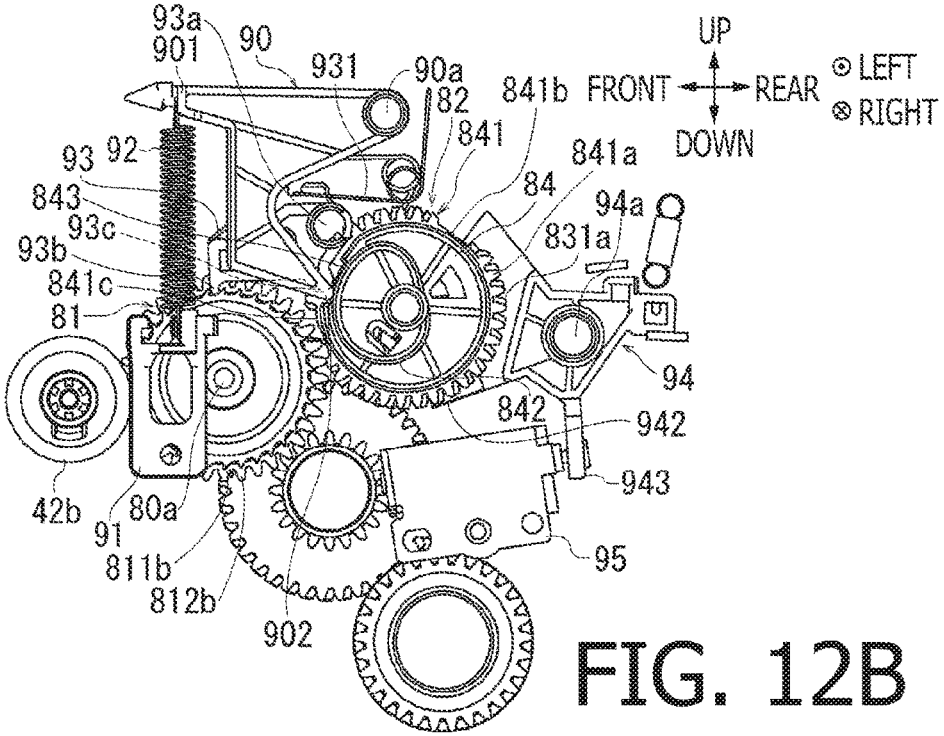
Figure 13:
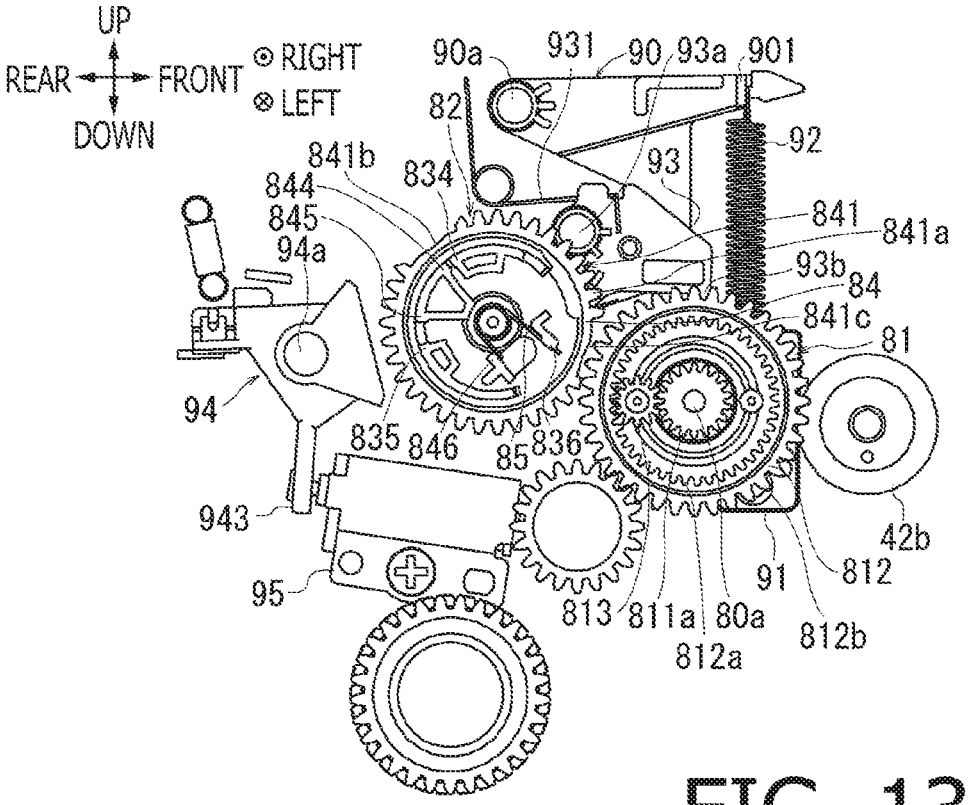
FIG. 13 is a cross-sectional view of the mode-switching gear for the sheet conveyer toward the right with the first gear and the second gear being at the rotational position where the second no-tooth section and the fourth no-tooth section are at the position coincident with the driving gear according to the embodiment of the present disclosure.

As shown in FIGS. 12A-12B and 13, when the first gear 83 and the second gear 84 rotated by the driving force from the driving gear 80 reach the rotational position, where the second no-tooth section 83*c* and the second no-tooth section 84*c* are located to coincide with the driving gear 80, in other words, the first teethed section 831*a* and the second teethed section 841*a* are released from the driving gear 80, the driving force from the driving gear 80 is no longer supplied to the first gear 83 or the second gear 84. In this regard, however, the first gear 83 is maintained movable to be rotated by another force. Meanwhile, the third urging member 96 is engaged with the second engagement block 838 to urge the first gear 83 in the first rotating direction. Therefore, the first gear 83 is rotated by the urging force from the third urging member 96 to the rotational position, where the second locking section 942 in the lock lever 94 engages with the second lock-engageable section 833 in the first gear 83.

As the first gear 83 and the second gear 84 are rotated to the rotational position, where the first teethed section 831*a* and the second teethed section 841*a* are disengaged from the driving gear 80, the load applier lever 90 is moved by the first cam section 842 to the first position. Meanwhile, the second gear 84 is subjected to a load, which is produced by the contact section 902 in the load applier lever 90 contacting the first cam section 842, to act in the rotating direction. In other words, the load from the load applier lever 90 is applied to the first cam section 842. Therefore, when the second gear 84 reaches the rotational position, where the fourth no-tooth section 841*c* is located to coincide with the driving gear 80, the driving force from the driving gear 80 is braked by the load that acts in the rotating direction, and the second gear 84 stops rotating.

In this regard, an intensity of the urging force from the third urging member 96 to urge the first gear 83 in the first rotating direction is set to be greater than an intensity of the urging force from the second urging member 85 applied to the first gear 83 and the second gear 84. Therefore, even after the second gear 84 stops rotating, the first gear 83 may be rotated by the urging force from the third urging member 96 further to the position, where second lock-engageable section 833 in the first gear 83 is engaged with the second locking section 942 in the lock lever 94.

Meanwhile, the intensity of the urging force from the second urging member 85 is set to be lower than the load, which may be applied by the load applier lever 90 in the first position to the second gear 84 through the contact between the load applier lever 90 and the first cam section 842, to act in the rotating direction. Therefore, the second gear 84 may stop rotating without being rotated along with the first gear 83 while the first gear 83 is rotated by the urging force from the third urging member 96.

Thus, when the first gear 83 and the second gear 84 reach the rotational position, where the second no-tooth section 83*c* is located to coincide with the driving gear 80, the load applier lever 90 is moved by the first cam section 842 to the first position, the arm 46 is subjected to the load that may act on the pickup roller 41 to be pressed against the sheet S, the switching lever 93 is moved by the second cam section 843 to the third position, and the clutch member 81 is switched to the transmittable state. In other words, the operation modes in the sheet conveyer 4 are switched from the first mode to the second mode.

When the sheet conveyer 4 is in the second mode, the pickup roller 41 and the separator roller 42 are driven to rotate so that the sheets S supported by the MP tray 21 may be separated from one another by the pickup roller 41 and the separator roller 42 and conveyed toward the image forming unit 5. Meanwhile, the solenoid 95 is maintained activated for a length of time, which is required for the sheet conveyer 4 to convey the sheets S for a predetermined conveyance amount, and may be inactivated thereafter.

When the solenoid 95 is inactivated, the lock lever 94 moves from the second locking position to the first locking position, in which the second locking section 942 in the lock lever 94 is disengaged from the second lock-engageable section 833 in the first gear 83, and the first gear 83 is released to rotate in the first rotating direction.

The first gear 83, which is at the rotational position where the second no-tooth section 83*c* is located to coincide with the driving gear 80, is urged by the third urging member 96 in the first rotating direction. Therefore, once the first gear 83 is released to rotate, the first gear 83 is rotated by the urging force from the third urging member 96 to the rotational position, where the first teethed section 831*a*, located behind from the first no-tooth section 831*b* along the first rotating direction, meshes with the driving gear 80. While the first gear 83 is rotated by the urging force of the third urging member 96, the second gear 84 stays stationary due to the load that may act in the rotating direction caused by the contact between the load applier lever 90 and the first cam section 842.

Figure 14A:
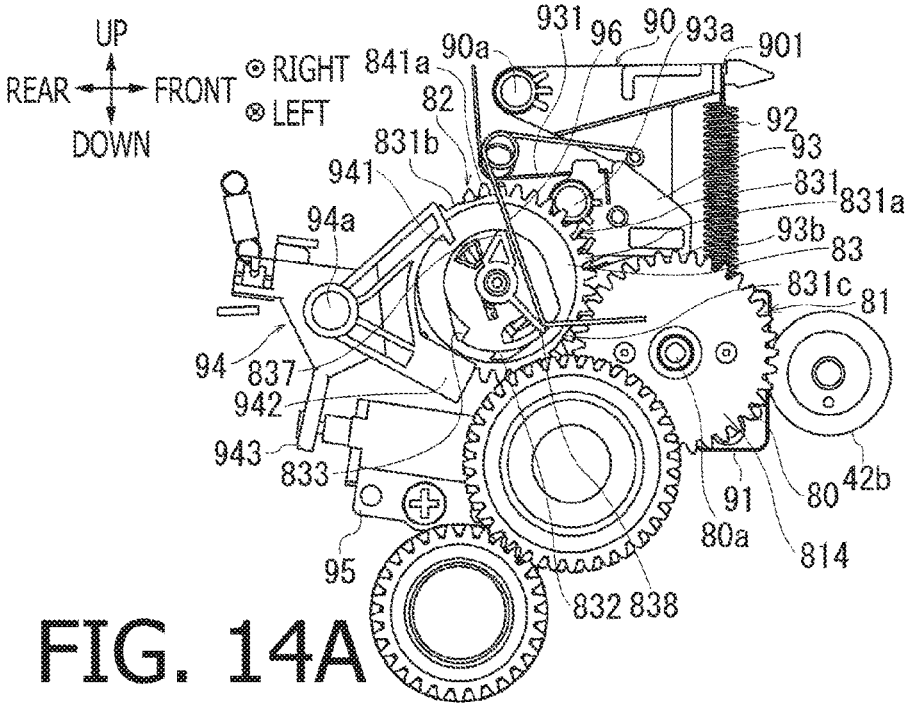
FIGS. 14A-14B are sideward views of the mode-switching gear for the sheet conveyer toward the right and the left, respectively, with the first gear being urged in a first rotating direction by a third urging member toward a rotational position, in which a first teethed section meshes with the driving gear, according to the embodiment of the present disclosure.
Figure 14B:
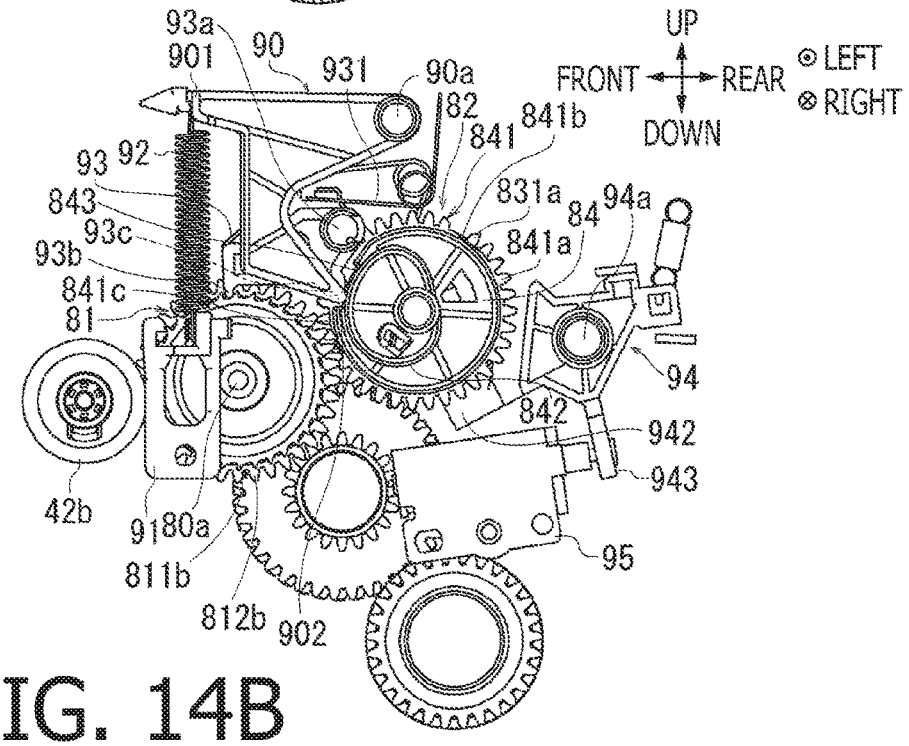
Figure 15:
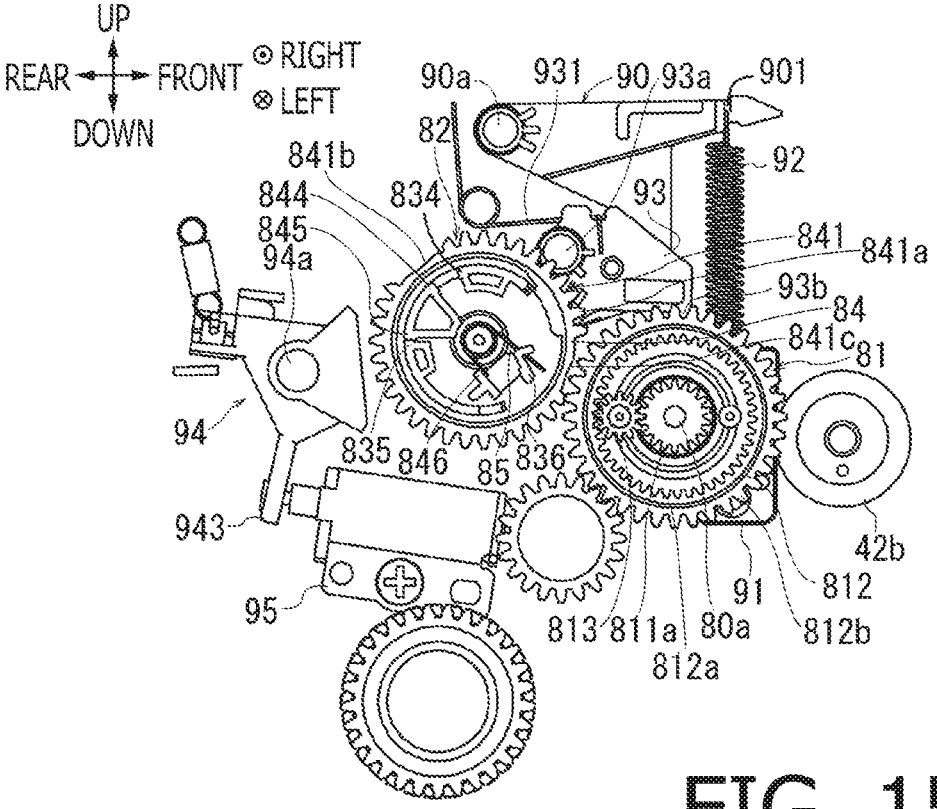
FIG. 15 is a cross-sectional view of the mode-switching gear for the sheet conveyer toward the right with the first gear being urged in the first rotating direction by the third urging member toward the rotational position, in which the first teethed section meshes with the driving gear, according to the embodiment of the present disclosure.

By the time the first gear 83 reaches the rotational position where the first teethed section 831*a* meshes with the driving gear 80, as shown in FIGS. 14A-14B and 15, the second gear 84 stays stationary. In other words, the second gear 84 is at the rotational position deviated behind along the first rotating direction from a rotational position, in which the phase of the second teethed section 841 coincides with the phase of the first teethed section 831*a*, for the rotational amount equivalent to two (2) teeth. At this deviated rotational position, the engageable edge 835 in the first gear 83 and the engageable edge 845 in the second gear 84 contacts each other.

While the first gear 83 is at the rotational position where the first teethed section 831*a* meshes with the driving gear 80, and the first gear 83 is released to rotate by the driving force from the driving gear 80, with the engageable edge 835 being in contact with the engageable edge 845, the second gear 84 may be pushed by the first gear 83 in the first rotating direction and rotate along with the first gear 83. As the second gear rotates 84, the second teethed section 841*a* meshes with the driving gear 80, and the second gear 84 is enabled to rotate by the driving force from the driving gear 80. While the intensity of the driving force input to the second gear 84 from the driving gear 80 is greater than the load applied by the load applier lever 90 contacting the first cam 842 to act on the second gear 84 in the rotating direction, the second gear 84 is be rotated by the driving force from the driving gear 80.

As the first gear 83 and the second gear 84 rotate by the driving force from the driving gear 80 and reach at the rotational position, in which the first no-tooth section 831*b* and the third no-tooth section 841*b* are located to coincide with the driving gear 80, the load applier lever 90 is moved by the first cam 842 to the second position, in which no load from the load applier lever 90 may be applied to the arm 46. Therefore, the pickup roller 41 may merely contact the sheet S on the MP tray 21 by the weight thereof. Meanwhile, the switching lever 93 is moved by the second cam 843 to the fourth position, in which the clutch member 81 is placed in the disconnected state. Thus, the pickup roller 41 and the separator roller 42 stops rotating.

As the first gear 83 rotates to reach the rotational position, in which the first no-tooth section 831*b* is located to coincide with the driving gear 80, in other words, the first teethed section 831*a* is disengaged from the driving gear 80, the driving force from the driving gear 80 may no longer be supplied to the first gear 83. In this regard, however, the first gear 83 is maintained rotatable, and the third urging member 96 is engaged with the second engagement block 838 to urge the first gear 83 in the first rotating direction. Therefore, the first gear 83 is rotated by the urging force from the third urging member 96 to the rotational position, where the second locking section 942 in the lock lever 94 engages with the second lock-engageable section 833 in the first gear 83.

Meanwhile, the second gear 84 is, by the time when the first gear 83 reached the rotational position where the first no-tooth section 831*b* is located to coincide with the driving gear 80, still meshed with the driving gear 80 by the last two teeth in the second teethed section 841*a*. Therefore, the second gear 84 is rotated further for the amount equivalent to the two teeth. As the second gear 84 is rotated by the driving gear 80 for the amount equivalent to the two teeth, the second teethed section 841 is released from the driving gear 80, and the second gear 84 is turned relatively to the first gear 83 by the urging force from the second urging member 85.

Thereby, the second gear 84 is placed in a phase, in which the engageable block 844 contacts the engageable edge 834. Thus, the phase of the second teethed section 841*a* again coincides with the phase of the first teethed section 831*a* in the first gear 83, which is locked stationary by the lock lever 94. Thus, the first gear 83 and the second gear 84 return to the initial positions, which are shown in FIGS. 5A-5B and 6.

After the second teethed section 841*a* is disengaged from the driving gear 80, at the time when the second gear 84 reaches the rotational position where the third no-tooth section 841*b* is located to coincide with the driving gear 80, the intensity of the urging force from the second urging member 85 is set to be greater than the load to be applied to the second gear 84, which is produced by the load applier lever 90 in the second position contacting the first cam section 842 and the switching lever 93 in the fourth position contacting the second cam section 843. With this difference between the urging force from the second urging member 85 and the load from the load applier lever 90, the second gear 84 is turned relatively to the first gear 83 by the second urging member 85 in the first rotating direction.

[Modified Example of Mode Switching Gear]

Although an example of carrying out the invention has been described, those skilled in the art will appreciate that there are numerous variations and permutations of the sheet conveyer and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the mode-switching gear 82 described above may not necessarily include the first gear 83 and the second gear 84 but may be replaced by a single gear.

Figure 16A:
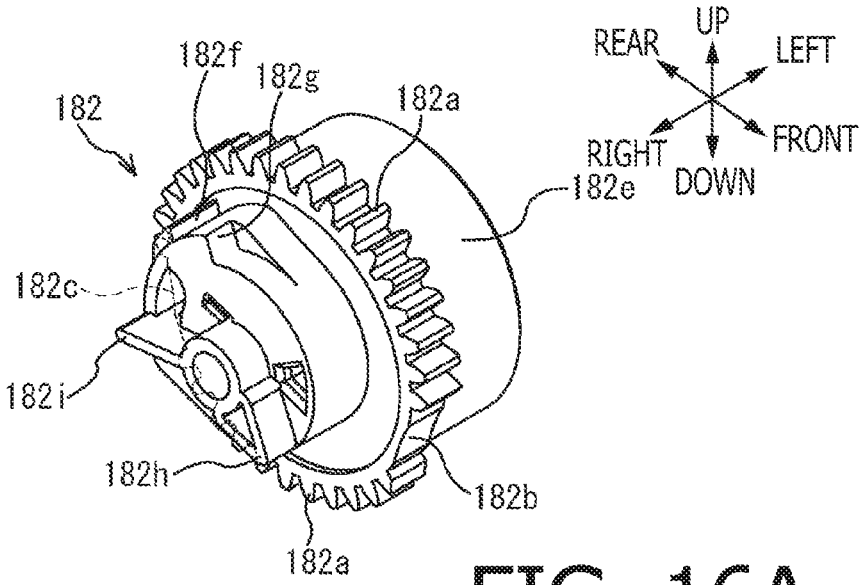
FIGS. 16A-16B are perspective views of a modified example of the mode switching gear according to the embodiment of the present disclosure viewed from a rightward upper-front position and a leftward upper-front position, respectively.
Figure 16B:
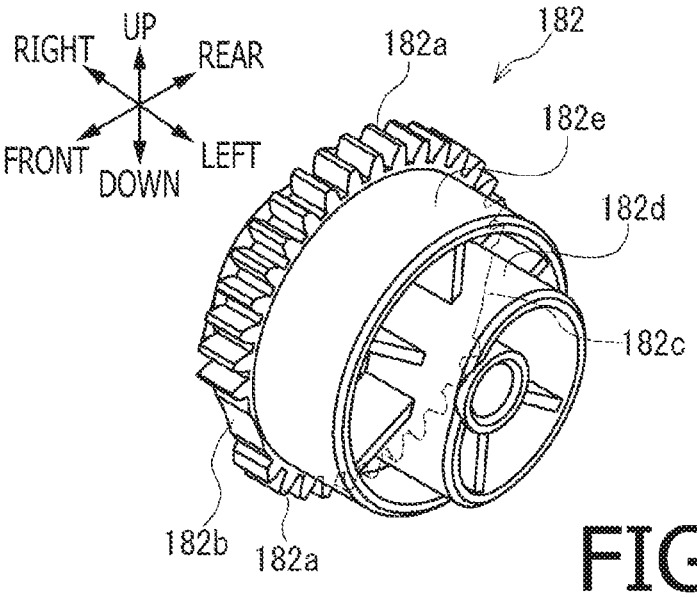

More specifically, as shown in FIGS. 16A-16B, a mode-switching gear 184 having teethed sections 182*a*, a first no-tooth section 182*b*, a second no-tooth section 182*c*, a first cam section 182*d*, and a second cam section 182*e* may replace the mode-switching gear 82. The teethed sections 182*a* may mesh with the driving gear 80. The first no-tooth section 182*b* and the second no-tooth section 182*c* having no tooth to mesh with the driving gear 80 may be formed at different phases from each other. The first cam section 182*d* may contact the load applier lever 90 to move the load applier lever 90 between the first position and the second position. The second cam section 182*e* may contact and move the switching lever 93 between the third position and the fourth position.

When the mode-switching gear 182 is at a rotational position, in which one of the first teethed sections 182*a* is located to coincide with the driving gear 80, the teethed section 182*a* may mesh with the driving gear 80. When the mode-switching gear 182 is at another rotational position, in which either the first no-tooth section 182*b* or the second no-tooth section 182*c* is located to coincide with the driving gear 80, the mode-switching gear 182 may not mesh with the driving gear 80. The mode-switching gear 182 may rotate when the teethed section 182*a* is meshed with the driving gear 80. The rotating direction of the mode-switching gear 182, which is rotated by the driving gear 80, when the driving gear 80 meshes with the teethed section 182*a*, is the first rotating direction.

The mode-switching gear 182 may include a first lock-engageable section 182*f* and a second lock-engageable section 182*g*. The first lock-engageable section 182*f* may be engaged with the first locking section 941 in the lock lever 94 when the mode-switching gear 182 is at the rotational position where the first no-tooth section 182*b* is located to coincide with the driving gear 80. The second lock-engageable section 182*g* may be engaged with the second locking section 942 in the lock lever 94 when the mode-switching gear 182 is at the rotational position where the second no-tooth section 182*c* is located to coincide with the driving gear 80.

Furthermore, the mode-switching gear 182 may include an engageable block 182*h* and an engageable block 182*i*. The engageable block 182*h* may be engaged with the third urging member 96 when the mode switching gear 182 is at the rotational position where the first no-tooth section 182*b* is located to coincide with the driving gear 80. The engageable block 182*i* may be engaged with the third urging member 96 when the mode switching gear 182 is at the rotational position where the second no-tooth section 182*c* is located to coincide with the driving gear 80.

The sheet conveyer 4 with the mode-switching gear 182 described above may as well be operable in the first mode, in which the mode-switching gear 182 is at the rotational position where the first no-tooth section 182*b* is located to coincide with the driving gear 80, the load applier lever 90 is moved by the first cam section 182*d* to the second position, the pickup roller 41 contacts the sheet S by to the weight thereof, the switching lever 93 is moved by the second cam section 182*e* to the fourth position, and the clutch member 81 is placed at the disconnected state; and in the second mode, in which the mode switching gear 182 is at the rotational position where the second no-tooth section 182*b* is located to coincide with the driving gear 80, the load applier lever 90 is moved by the first cam section 182*d* to the first position, the pickup roller 41 is pressed against the sheet S by the load applied by the load applier lever 90 through the arm 46, the switching lever 93 is moved by the second cam section 182*e* to the third position, and the clutch member 81 is placed in the transmittable state.

[Benefits]

The sheet conveyer 4 in the image forming apparatus 1 in the present embodiment includes, as has been described, the MP tray 21, the pickup roller 41, the separator roller 42, the motor 11, the roller holder 45 with the arm 46, the engagement member 91, the load applier lever 90, and the first urging member 92. The load applier lever 90 is movable between the first position, in which the load applier lever 90 supports the first end of the first urging member 92 at the position where the first urging member 92 is deformed from the natural length thereof and causes the engagement member 91 coupled to the second end thereof to be urged against the arm 46 and to apply the load that acts in the direction to cause the pickup roller 41 to be pressed against the sheets S to the arm 46; and the second position, in which the load applier lever 90 supports the first end of the first urging member 92 at the position where the first urging member 92 is in the natural length thereof without causing the engagement member 91 coupled to the second end of the first urging member 92 to be urged against the arm 46.

Therefore, when no substantial driving force is supplied to the separator roller 42 or the pickup roller 41, that is, when no sheet S is to be fed, the load applier lever 90 may be located at the second position so that the pickup roller 41 may merely contact the sheet S without being subjected to the load from the load applier lever 90. On the other hand, while the driving force is supplied to the separator roller 42 and the pickup roller 41 so that the sheets S are to be fed to the image forming unit 5, the load applier lever 90 may be located at the first position so that the pickup roller 41 may be pressed against the sheets S by the load applied by the load applier lever 90.

Thus, in both of the operational modes, in which the sheets S may be fed to be separated, and in which no sheet S is to be fed, the pickup roller 41 may maintained in contact with the sheet S. Therefore, a noise, which may be produced when the operational modes are switched between the feeding-and-separating condition and the no-feeding condition, may be reduced.

The sheet conveyer 4 may include the driving gear 80; the clutch member 81; the switching lever 93; the mode-switching gear 182 with the teethed section 182*a*, the first no-tooth section 182*b*, the second no-tooth section 182*c*, the first cam section 182*d*, and the second cam section 182*e*; the lock lever 94 with the first locking section 941 and the second locking section 942 engageable with the mode-switching gear 182; the solenoid 95, and the urging member 96 to urge the mode-switching gear 182 in the first rotating direction. When the mode-switching gear 182 is at the rotational position where the first no-tooth section 182*b* is located to coincide with the driving gear 80, the sheet conveyer 4 may operate in the first mode, in which the load applier lever 90 may be moved by the first cam section 182*d* to the second position, the pickup roller 41 may contact the sheets S by the weight thereof, the switching lever 93 may be moved by the second cam section 182*e* to the fourth position, and the clutch member 81 may be placed in the disconnected state. When the mode-switching gear 182 is at the rotational position where the second no-tooth section 182*c* is located to coincide with the driving gear 80, the sheet conveyer 4 may operate in the second mode, in which the load applier lever 90 may be moved by the first cam section 182*d* to the first position, the pickup roller 41 may contact the sheets S by the load applied to the arm 46 by the load applier lever 90, the switching lever 93 may be moved by the second cam section 182*e* to the third position, and the clutch member 81 is placed in the transmittable state.

Thus, the operational modes in the sheet conveyer 4 may be switched between the first mode, in which the clutch member 81 is in the disconnected state so that the separator roller 42 may feed no sheet S, and the second mode, in which the clutch member 81 is in the transmittable state to drive the separator roller 42 so that the sheets S may be separated from one another, without separating the pickup roller 41 from the sheets S or placing back on the sheets S to contact the sheets S. In other words, the pickup roller 41 may be maintained in contact with the sheet S, with the load on the pickup roller 41 against the sheet S being varied, while the operational modes are switched from one to the other. Thus, the noise that may be produced when the operational modes are switched between the first mode and the second mode may be reduced.

The sheet conveyer 4 may include the driving gear 80; the clutch member 81; the switching lever 93; the mode-switching gear 82 with the first gear 83, the second gear 84, and the second urging member 85; the lock lever 94 with the first locking section 941 engageable with the first lock-engageable section 832 in the first gear 83 and the second locking section engageable with the second lock-engageable section 833 in the first gear 83, the solenoid 95, and the third urging member 96 to urge the first gear 83 in the first rotating direction. When the second gear 84 is in the rotational position where the third no-tooth section 841*b* in the second gear 84 is located to coincide with the driving gear 80, the sheet conveyer 4 may operate in the first mode, in which the load applier lever 90 may be moved by the first cam section 842 to the second position, the pickup roller 41 may contact the sheets S by the weight thereof, the switching lever 93 may be moved by the second cam section 843 to the fourth position, and the clutch member 81 may be placed in the disconnected state. When the second gear 84 is in the rotational position where the fourth no-tooth section 84*c* in the second gear 84 is located to coincide with the driving gear 80, the sheet conveyer 4 may operate in the second mode, in which the load applier lever 90 may be moved by the first cam section 842 to the first position, the pickup roller 41 may be pressed against the sheets S due to the load applied to the arm 46 by the load applier lever 90, the switching lever 93 may be moved by the second cam section 843 to the third position, and the clutch member 81 may be placed in the transmittable state.

Thus, even when the second gear 84 is under the load that may act in the rotating direction while the load applier lever 90 being at the first position is in contact with the first cam 842, the intensity of the force required to move the lock lever 94 from the second locking position to the first locking position and to move the second locking section 942 in the lock lever 94 to be separated from the second lock-engageable section 833 in the first gear 83 may not necessarily be greater than an intensity of the force that may act against the urging force of the second urging member 85, which is lower than the load to be applied to the second gear 84. Therefore, an intensity of the output by the solenoid 95 to move the lock lever 94 may be lowered. In other words, the solenoid 95 with a lower output capability may be employed, and consumption of electricity or heat generation may be restrained.

Further, the clutch member 81 may include the sun gear 811, the ring gear 812, the planet gears 813, 813, and the carrier 814, When the switching lever 93 is located at the third position, the switching lever 93 may engage with the sun gear 811 to restrict the sun gear 811 from rotating and place the clutch member 81 in the transmittable state, in which the driving force from the driving gear 80 is output through the ring gear 812 to the separate roller 42. On the other hand, when the switching lever 93 is located at the fourth position, the switching lever 93 may be disengaged from the sun gear 811 to allow the run gear 811 to rotate and place the clutch member 81 in the disconnected state, in which transmission of the driving force through the ring gear 812 may be discontinued.

With this configuration, unlike an electromagnetic clutch, the states in the clutch member may be switched between the transmittable state and the disconnected state by the driving force from the motor 11, which supplies the driving force to the separator roller 42, without consuming electricity.

What is claimed is:

1. A sheet conveyer, comprising:

a tray configured to support sheets;

a pickup roller configured to rotate and convey the sheets in a conveying direction;

a separator roller arranged downstream from the pickup roller along the conveying direction;

a separator pad arranged to face the separator roller, the separator pad and the separator roller being configured to separate the sheets conveyed by the pickup roller from one another at a position between the separator pad and the separator roller;

a first rotation shaft configured to support the separator roller;

a driving source configured to supply a driving force to the separator roller and the pickup roller;

a roller holder comprising an arm, the roller holder being pivotably supported by the first rotation shaft to pivot about the first rotation shaft, the roller holder being configured to support the pickup roller rotatably to rotate about a rotation axis of the pickup roller, the roller holder being configured to support the separator roller rotatably at an intervening position between the arm and the pickup roller to rotate about the first rotation shaft;

an engagement member engageable with the arm;

a load applier lever; and a first urging member coupled with the load applier lever at a first end thereof and coupled with the engagement member at a second end thereof, wherein the load applier lever is movable between:

a first position, in which the load applier lever supports the first end of the first urging member at a position where the first urging member is deformed from a natural length thereof and causes the engagement member coupled to the second end thereof to be urged against the arm and to apply a load that acts in a direction to cause the pickup roller to be pressed against the sheets supported on the tray to the arm, and in which the driving force is transmitted to the pickup roller and the pickup roller is enabled to convey a sheet; and a second position, in which the load applier lever supports the first end of the first urging member at a position where the first urging member is in the natural length thereof without causing the engagement member coupled to the second end thereof to be urged against the arm, and in which the driving force is not transmitted to the pickup roller and the pickup roller is disabled to convey a sheet, wherein the load applier lever moving between the first position and the second position involves switching between a condition, in the first position, in which the driving force is transmitted to the pickup roller and a condition, in the second position, in which the driving force is not transmitted to the pickup roller.

2. The sheet conveyer according to claim 1, further comprising:

a driving gear configured to be driven by the driving force from the driving source;

a clutch member arranged between the driving gear and the separator roller, the clutch member being configured to switch states of transmission between a transmittable state, in which the driving force is transmitted from the driving gear to the separator roller, and a disconnected state, in which the driving force is not transmitted from the driving gear to the separator roller;

a switching lever configured to move between a third position, in which the switching lever engages with the clutch member to place the clutch member in the transmittable state, and a fourth position, in which the switching lever is disengaged from the clutch member to place the clutch member in the disconnected state;

a mode-switching gear, comprising:

a teethed section, in which teeth are formed, the teethed section being configured to mesh with the driving gear, the teethed section meshed with the driving gear enabling the mode-switching gear to rotate in a first rotating direction;

a first no-tooth section, in which no tooth is formed;

a second no-tooth section arranged in a different phase from the first no-tooth section;

a first cam section configured to contact and move the load applier lever between the first position and the second position, and a second cam section configured to contact and move the switching lever between the third position and the fourth position;

a lock lever comprising a first locking section and a second locking section, the first locking section and the second locking section each being engageable with the mode-switching gear, the lock lever being movable between:

a first locking position, in which the first locking section engages with the mode-switching gear while the second locking section is disengaged from the mode-switching gear, and in which the mode-switching gear is maintained stationary at a rotational position where the first no-tooth section is located to coincide with the driving gear; and a second locking position, in which the second locking section engages with the mode-switching gear while the first locking section is disengaged from the mode-switching gear, and in which the mode-switching gear is maintained stationary at a rotational position where the second no-tooth section is located to coincide with the driving gear;

a solenoid connected with the lock lever, the solenoid being configured to move the lock lever between the first locking position and the second locking position; and a gear-urging member configured to urge the mode-switching gear to rotate in the first rotating direction from one of the rotational position, in which the first no-tooth section is located to coincide with the driving gear, and the rotational position, in which the second no-tooth section is located to coincide with the driving gear, to a rotational position, in which the teethed section meshes with the driving gear, wherein operational modes in the sheet conveyer is switchable between:

a first mode, in which the mode-switching gear is at the rotational position where the first no-tooth section is located to coincide with the driving gear, the load applier lever is moved by the first cam section to the second position, the pickup roller contacts the sheets by a weight thereof, the switching lever is moved by the second cam section to the fourth position, and the clutch member is placed in the disconnected state; and a second mode, in which the mode-switching gear is located at the rotational position where the second no-tooth section is located to coincide with the driving gear, the load applier lever is moved by the first cam section to the first position, the pickup roller is pressed against the sheets due to the load applied to the arm by the load applier lever, the switching lever is moved by the second cam section to the third position, and the clutch member is placed in the transmittable state.

3. The sheet conveyer according to claim 2, wherein the clutch member comprises:

a sun gear configured to rotate about a second rotation shaft being a rotation shaft of the driving gear;

a ring gear configured to rotate about the second rotation shaft, the ring gear comprising inward teeth on an inner circumference thereof, the ring gear being configured to rotate relatively to the sun gear;

a planet gear arranged between the sun gear and the ring gear, the planet gear being configured to mesh with the sun gear and with the inward teeth of the ring gear; and a carrier configured to rotate about the second rotation shaft integrally with the driving gear, the carrier being configured to support the planet gear rotatably to rotate about a third rotation shaft being a rotation shaft of the planet gear and revolvably around the second rotation shaft, the carrier being configured to rotate relatively to the sun gear and to the ring gear, wherein the switching lever located at the third position engages with the sun gear to restrict the sun gear from rotating and places the clutch member in the transmittable state, in which the driving force from the driving gear is output through the ring gear to the separator roller, and wherein the switching lever located at the fourth position is disengaged from the sun gear to allow the sun gear to rotate and places the clutch member in the disconnected state, in which transmission of the driving force through the ring gear is discontinued.

4. The sheet conveyer according to claim 1, further comprising:

a driving gear configured to be driven by the driving force from the driving source;

a clutch member arranged between the driving gear and the separator roller, the clutch member being configured to switch states of transmission between a transmittable state, in which the driving force is transmitted from the driving gear to the separator roller, and a disconnected state, in which the driving force is not transmitted from the driving gear to the separator roller;

a switching lever configured to move between a third position, in which the switching lever engages with the clutch member to place the clutch member in the transmittable state, and a fourth position, in which the switching lever is disengaged from the clutch member to place the clutch member in the disconnected state;

a mode-switching gear comprising:

a first gear comprising a first gear section, a first lock-engageable section and a second lock-engageable section configured to rotate integrally with the first gear section, the first gear section comprising:

a first teethed section, in which teeth are formed, the first teethed section being configured to mesh with the driving gear, the first teethed section meshed with the driving gear enabling the first gear to rotate in a first direction;

a first no-tooth section, in which no tooth is formed; and a second no-tooth section arranged in a different phase from the first no-tooth section;

a second gear comprising a second gear section, a first cam section configured to contact and move the load applier lever between the first position and the second position, and a second cam section configured to contact and move the switching lever between the third position and the fourth position, the second gear section comprising:

a second teethed section, in which teeth are formed, the second teethed section being configured to mesh with the driving gear, the second teethed section meshed with the driving gear enabling the second gear to rotate about a rotation axis of the first gear in a first rotating direction and turn relatively to the first gear within a predetermined angle range;

a third no-tooth section, in which no tooth is formed; and a fourth no-tooth section arranged in a different phase from the third no-tooth section;

a second urging member configured to urge the second gear to turn relatively to the first gear in the first rotating direction, an intensity of an urging force of the second urging member to urge the second gear against the first gear being lower than an intensity of a load, which is produced by the load applier lever at the first position contacting the first cam section and causes the second gear to turn relatively to the first gear in the first rotating direction;

a lock lever comprising a first locking section, the first locking section being engageable with the first lock-engageable section, and a second locking section, the second locking section being engageable with the second lock-engageable section, the lock lever being movable between:

a first locking position, in which the first locking section engages with the first lock-engageable section while the second locking section is disengaged from the second lock-engageable section, and in which the first gear is maintained stationary at a rotational position where the first no-tooth section in the first gear is located to coincide with the driving gear; and a second locking position, in which the second locking section engages with the second lock-engageable section while the first locking section is disengaged from the first lock-engageable section, and in which the first gear is maintained stationary at a rotational position where the second no-tooth section is located to coincide with the driving gear;

a solenoid connected with the lock lever, the solenoid being configured to move the lock lever between the first locking position and the second locking position; and a third urging member configured to urge the first gear to rotate in the first rotating direction from one of the rotational position, in which the first no-tooth section in the first gear is located to coincide with the driving gear, and the rotational position, in which the second no-tooth section in the first gear is located to coincide with the driving gear, to a rotational position, in which the first teethed section in the first gear meshes with the driving gear, wherein operational modes in the sheet conveyer is switchable between:

a first mode, in which the second gear is at a rotational position where the third no-tooth section in the second gear is located to coincide with the driving gear, the load applier lever is moved by the first cam section to the second position, the pickup roller contacts the sheets by a weight thereof, the switching lever is moved by the second cam section to the fourth position, and the clutch member is placed in the disconnected state; and a second mode, in which the second gear is located at a rotational position where the fourth no-tooth section in the second gear is located to coincide with the driving gear, the load applier lever is moved by the first cam section to the first position, the pickup roller is pressed against the sheets due to the load applied to the arm by the load applier lever, the switching lever is moved by the second cam section to the third position, and the clutch member is placed in the transmittable state.

5. The sheet conveyer according to claim 4, wherein the clutch member comprises:

a sun gear configured to rotate about a second rotation shaft being a rotation shaft of the driving gear;

a ring gear configured to rotate about the second rotation shaft, the ring gear comprising inward teeth on an inner circumference thereof, the ring gear being configured to rotate relatively to the sun gear;

a planet gear arranged between the sun gear and the ring gear, the planet gear being configured to mesh with the sun gear and with the inward teeth of the ring gear; and a carrier configured to rotate about the second rotation shaft integrally with the driving gear, the carrier being configured to support the planet gear rotatably to rotate about a third rotation shaft being a rotation shaft of the planet gear and revolvably around the second rotation shaft, the carrier being configured to rotate relatively to the sun gear and to the ring gear, wherein the switching lever located at the third position engages with the sun gear to restrict the sun gear from rotating and places the clutch member in the transmittable state, in which the driving force from the driving gear is output through the ring gear to the separator roller; and wherein the switching lever located at the fourth position is disengaged from the sun gear to allow the sun gear to rotate and places the clutch member in the disconnected state, in which transmission of the driving force through the ring gear is discontinued.

6. The sheet conveyer according to claim 1, wherein when the load applier lever is at the first position, the first urging member is deformed to be longer than the natural length thereof.

7. An image forming apparatus, comprising:

a sheet conveyer, comprising:

a tray configured to support sheets;

a pickup roller configured to rotate and convey the sheets in a conveying direction;

a separator roller arranged downstream from the pickup roller along the conveying direction;

a separator pad arranged to face the separator roller, the separator pad and the separator roller being configured to separate the sheets conveyed by the pickup roller from one another at a position between the separator pad and the separator roller;

a rotation shaft configured to support the separator roller;

a driving source configured to supply a driving force to the separator roller and the pickup roller;

a roller holder comprising an arm, the roller holder being pivotably supported by the rotation shaft to pivot about the rotation shaft, the roller holder being configured to support the pickup roller rotatably to rotate about a rotation axis of the pickup roller, the roller holder being configured to support the separator roller rotatably at an intervening position between the arm and the pickup roller to rotate about the rotation shaft;

an engagement member engageable with the arm;

a load applier lever; and an urging member coupled with the load applier lever at a first end thereof and coupled with the engagement member at a second end thereof; and an image forming unit configured to form images on the sheets conveyed by the sheet conveyer, wherein the load applier lever is movable between:

a first position, in which the load applier lever supports the first end of the urging member at a position where the urging member is deformed from a natural length thereof and causes the engagement member coupled to the second end thereof to be urged against the arm and to apply a load that acts in a direction to cause the pickup roller to be pressed against the sheets supported on the tray to the arm, and in which the driving force is transmitted to the pickup roller and the pickup roller is enabled to convey a sheet; and a second position, in which the load applier lever supports the first end of the urging member at a position where the urging member is in the natural length thereof without causing the engagement member coupled to the second end thereof to be urged against the arm, and in which the driving force is not transmitted to the pickup roller and the pickup roller is disabled to convey a sheet, wherein the load applier lever moving between the first position and the second position involves switching between a condition, in the first position, in which the driving force is transmitted to the pickup roller and a condition, in the second position, in which the driving force is not transmitted to the pickup roller.

8. The image forming apparatus according to claim 7, wherein when the load applier lever is at the first position, the urging member is deformed to be longer than the natural length thereof.

9. A sheet conveyer, comprising:

a tray configured to support sheets;

a pickup roller configured to rotate and convey the sheets in a conveying direction;

a separator roller arranged downstream from the pickup roller along the conveying direction;

a separator pad arranged to face the separator roller, the separator pad and the separator roller being configured to separate the sheets conveyed by the pickup roller from one another at a position between the separator pad and the separator roller;

a rotation shaft configured to support the separator roller;

a driving source configured to supply a driving force to the separator roller and the pickup roller;

a roller holder comprising an arm, the roller holder being pivotably supported by the rotation shaft to pivot about the rotation shaft, the roller holder being configured to support the pickup roller rotatably to rotate about a rotation axis of the pickup roller, the roller holder being configured to support the separator roller rotatably at an intervening position between the arm and the pickup roller to rotate about the rotation shaft;

an engagement member engageable with the arm;

a load applier lever; and an urging member coupled with the load applier lever at a first end thereof and coupled with the engagement member at a second end thereof, wherein the load applier lever is movable between:

a first position, in which the load applier lever supports the first end of the urging member at a position where the urging member is deformed from a specific length corresponding to a predetermined intensity of urging force and causes the engagement member coupled to the second end thereof to be urged against the arm and to apply a load that acts in a direction to cause the pickup roller to be pressed against the sheets supported on the tray to the arm, and in which the driving force is transmitted to the pickup roller and the pickup roller is enabled to convey a sheet; and a second position, in which the load applier lever supports the first end of the urging member at a position where the urging member is in the specific length corresponding to the predetermined intensity of urging force without causing the engagement member coupled to the second end thereof to be urged against the arm, and in which the driving force is not transmitted to the pickup roller and the pickup roller is disabled to convey a sheet, wherein the load applier lever moving between the first position and the second position involves switching between a condition, in the first position, in which the driving force is transmitted to the pickup roller and a condition, in the second position, in which the driving force is not transmitted to the pickup roller.

* * * * *